United States Patent [19]

Perrella et al.

[11] 4,248,289

[45] Feb. 3, 1981

[54] DIE CASTING MACHINE

[75] Inventors: Guido Perrella, Senneville, Canada; William E. Thompson, Anderson, Ind.

[73] Assignee: DBM Industries Limited, Quebec, Canada

[21] Appl. No.: 929,148

[22] Filed: Jul. 31, 1978

[30] Foreign Application Priority Data

Dec. 1, 1977 [GB] United Kingdom ..... 50179/77
Jun. 12, 1978 [CA] Canada ..... 305228

[51] Int. Cl.[3] ..... B22D 17/02; B22D 17/22; B22D 17/24; B22D 17/30

[52] U.S. Cl. ..... 164/153; 164/262; 164/270; 164/303; 164/316; 164/318; 164/338 H; 164/340; 164/347; 164/348

[58] Field of Search ..... 184/303, 312, 315, 316, 184/317, 318, 348, 340, 347, 443, 344, 338, 338 M, 4, 154, 413, 113, 338 H, 153, 262, 270; 198/813; 13/25

[56] References Cited

U.S. PATENT DOCUMENTS

| | | | |
|---|---|---|---|
| 777,870 | 12/1904 | Vellino | 164/318 |
| 1,378,984 | 5/1921 | Soss | 164/338 M X |
| 1,584,782 | 5/1926 | Lee | 164/344 X |
| 1,674,947 | 6/1928 | Bunce et al. | 13/25 |
| 2,145,448 | 1/1939 | Lester | 164/318 |
| 2,214,638 | 9/1940 | Kux | 164/340 |
| 2,581,418 | 1/1952 | Kohl | 164/340 X |
| 2,582,029 | 1/1952 | Halward | 164/317 |
| 2,689,989 | 9/1954 | Tretheway et al. | 164/338 M X |
| 3,056,178 | 10/1962 | Jagielski | 164/318 X |
| 3,491,827 | 1/1970 | Mace | 164/318 |
| 3,495,650 | 2/1970 | Perrella | 164/318 X |
| 3,667,248 | 6/1972 | Carlson | 164/348 X |
| 3,934,361 | 1/1976 | Johnson et al. | 198/813 |
| 4,013,116 | 3/1977 | Perrella | 164/303 X |
| 4,072,181 | 2/1978 | Kostura et al. | 164/338 M X |

FOREIGN PATENT DOCUMENTS 1400418 7/1975 United Kingdom ..... 164/344

*Primary Examiner*—R. L. Spruill
*Assistant Examiner*—Gus T. Hampilos
*Attorney, Agent, or Firm*—Beveridge, DeGrandi, Kline & Lunsford

[57] ABSTRACT

A die casting system comprises a machine of the balanced, dual movement type wherein the part is cast and trimmed without any lateral movement. Both halves of the molds or dies are moved equal distances to and from the part plane. The machine incorporates a system of metal injection on the mold parting line with a runner-drain provision; provision for supporting the part at a plurality of points after the die opening; hydraulic fluid volumetric flow reduction; various nozzle configuration options and a heat transfer system for the dies. In addition, a part trimming machine is disclosed together with a cable transfer for moving the part from the casting machine to the trimming machine.

11 Claims, 33 Drawing Figures

DIE CASTING MACHINE

BACKGROUND OF THE INVENTION

This invention relates to die casting machines and in particular to a system including a die casting machine of the balanced, dual movement type that incorporates two pairs of spaced, parallel cylinder assemblies each of which support a mold half, the pistons of the cylinders being secured to the machine frame and the cylinders moving thereon.

In a conventional die casting machine a frame is provided and a fixed or stationary plate upon which one-half of the mold for making the part is mounted on the frame. The other half of the mold is mounted upon a moving plate which allows the cast part to fall out of the machine when in the open position and the moving plate is clamped shut with sufficient force to contain the molten metal while the mold is being filled. In operation, the part separates from the half mold on the fixed plate (the cover half) and is retained on the half mold of the moving plate (the ejector half) as it moves open following solidification of the molten metal which was injected into the mold cavity. The part which was retained on the moving or ejector half of the mold must then be ejected from it to fall out or be transferred out of the machine. The one-sided motion described above is one of the major causes for the various and complicated types of automatic part-transfer mechanisms associated with conventional casting machines which have been retrofitted with some sort of part-transfer. The same problem then arises as the part is indexed to a secondary operation such as trimming wherein a similar one-sided machine is used. The part-transfer carrier is required to have both an indexing function and a lateral movement to match the plate closing and opening stroke as the part is brought into a fixed position for the desired operation.

This conventional form of machine was greatly improved upon by the machine shown in the U.S. Pat. No. to Perrella, 4,013,116 which issued on Mar. 22, 1977. This machine is much simpler than conventional devices in that the part was cast, indexed and removed from the machine for trimming without any lateral movement of the part. During processing the part is in a fixed plane and is transferred in that plane. The casting machine has balanced forces in which both plates and mold halves or dies are moved equal distances to and from the part plane and this balanced movement of mass cancels out the normal shock of starting and stopping heavy plates and tools, equalizes thermal expansion differences and automatically centers load deflections.

SUMMARY OF THE INVENTION

The balanced, centred, single plane machine principle of U.S. Pat. No. 4,013,116 is the basis for the present invention but on which numerous improvement and additional features have been added such as a cable conveyor of low mass and simple design for transfer of the parts out of the machine, a simple part carrier finger at the center line of the mold, metal-injection on the mold parting line, one half the normal stroke for plate movement and thus one half the non-productive time for machine opening and closure, a top core pin position on the mold parting line to stabilize the part position during mold-opening and eliminate the need for ejector pins on some types of parts, opportunity to add internal cores in both mold halves, and automatic loading clearance during installation of the mold and trim dies. The machine of the present invention is designed as a total integrated casting unit which will deliver a quality part cast and trimmed automatically at a present rate of production. As such it is one unit incorporating numerous features.

The main machine consists of a frame, mold mounting plates and hydraulic closing and opening cylinders having a simple deceleration system to eliminate closing shock. A standard and uniform basic mold configuration is provided and is adaptable to a large variety of part styles and is of pre-determined registry in the machine plates so as to eliminate mold miss-match because of thermal expansion or poor die set practices. Metal-injection of the machine is provided with an infinitely variable control capable of presetting to any desired speed or pressure, together with a self-contained molten metal supply with electric resistance heaters therein.

A self contained hydraulic power system is incorporated, using fire-resistant fluid. Provision is made to pre-heat the molds prior to the first shot. The machine features a self-contained heat unit for cooling the molds and eliminating lime deposits in the cooling passages all of which is automatically connected to the mold during installation without hoses or pipes. A cable transfer conveyor is also provided to carry the part on a finger to other secondary operations with adequate time before trimming for natural non-distortion cooling of the part prior to trimming, together with a complementary trim machine and basic trim die designs to push the part through the die to a carry-away conveyor.

According to one aspect, the invention relates to a die casting unit comprising, in combination: (a) die-casting machine having a frame with two pairs of spaced, parallel cylinder assemblies mounted thereon, each pair of assemblies supporting a mold half and being opposed to the other pair of assemblies carrying the other mold half, each cylinder assembly of each pair comprising (i) a stationary piston secured to the frame, (ii) a piston shaft secured to and coaxial with the piston, said shaft extending across to a connection with an opposed piston of the other pair, (iii) a cylinder mounted on the piston and shaft for reciprocal movement thereon in response to incompressible fluid injected therein on either side of said piston; (iv) means connecting said cylinder to a said mold half, whereby injection of fluid into the cylinders at the crown ends of the pistons forces the cylinders and mold halves together and injection of the fluid at the skirt ends of the pistons forces the cylinders and mold halves apart with the terminal forces from opening the cylinders being taken by the piston shaft; and (v) means for deceleration of said cylinders to eliminate closing shock, (b) evaporative heat control for said molds, (c) a metal injection system including means for injecting metal on the parting line of said molds, and a self-contained molten metal supply with electric resistance immersion heating means for said metal supply, and (e) means for withdrawal of the core pin prior to opening of the die.

The above and other features will be understood from the following disclosure and accompanying drawings wherein.

Figure 8A:
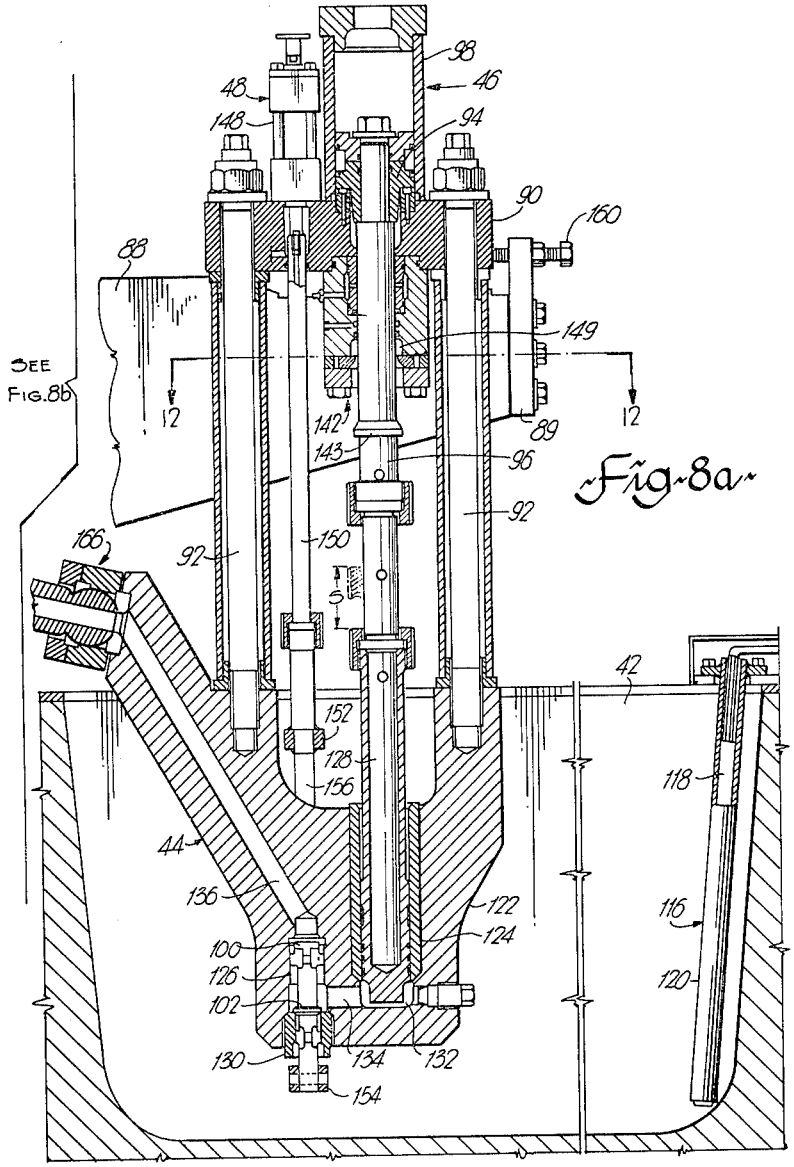
Figure 8B:
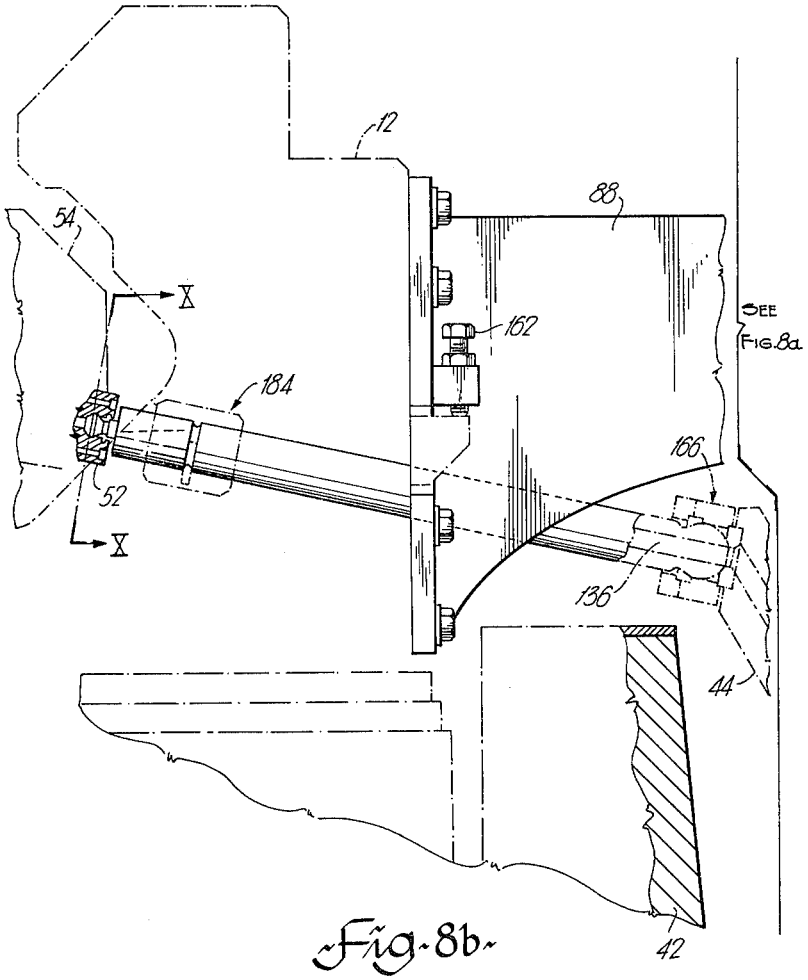
Figure 9:
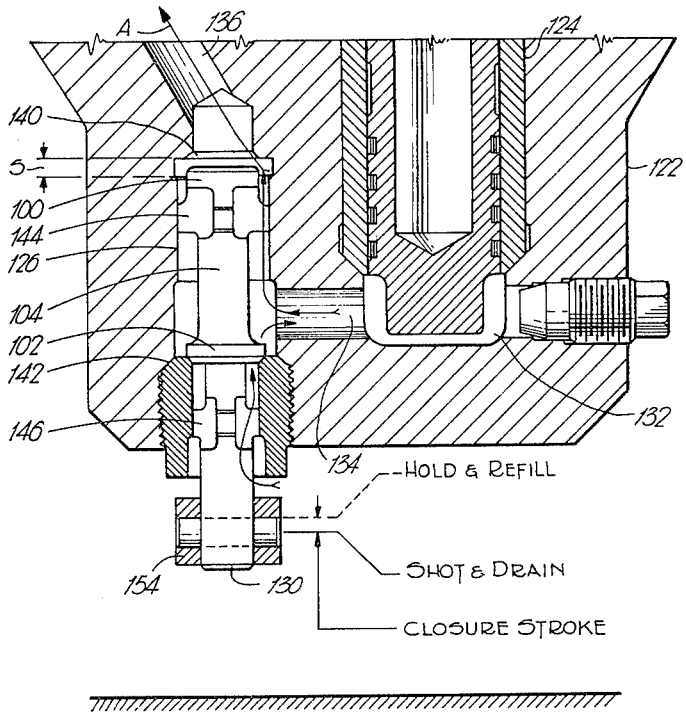
Figure 10:
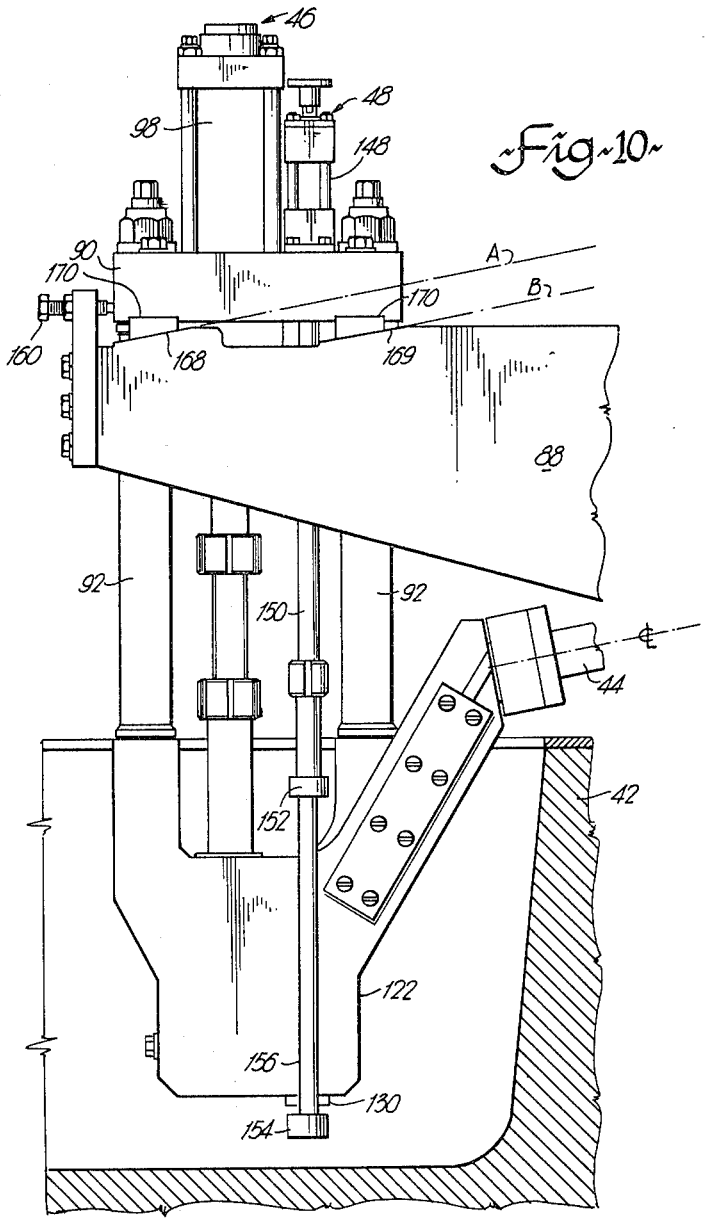
Figure 11:
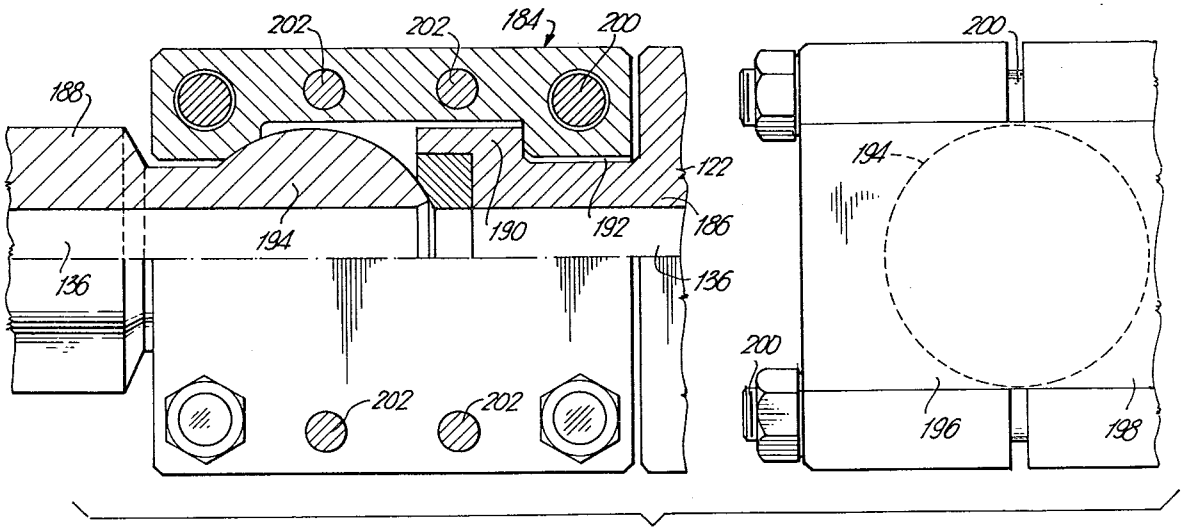
Figure 12:
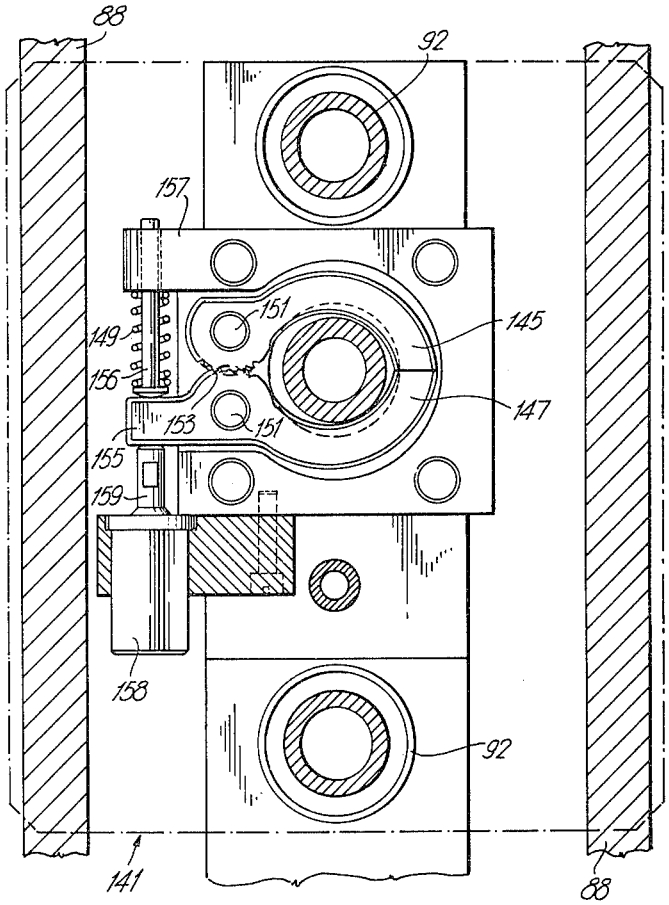

FIGS. 8*a* and 8*b* are cross sectional views of the metal injection unit;

FIGS. 9 is an enlarged cross sectional view of the valve mechanism of the injection unit;

FIG. 10 is a side elevation view of the injection unit;

FIG. 11 are elevation and end view of the swan's neck joint;

FIG. 12 is a cross sectional view taken along the line 12—12 of FIG. 8*a*.

Figure 13:
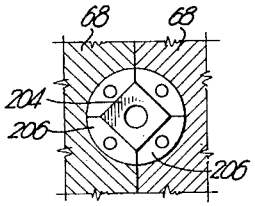
Figure 14:
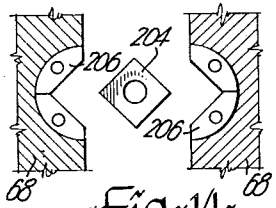
Figure 16:
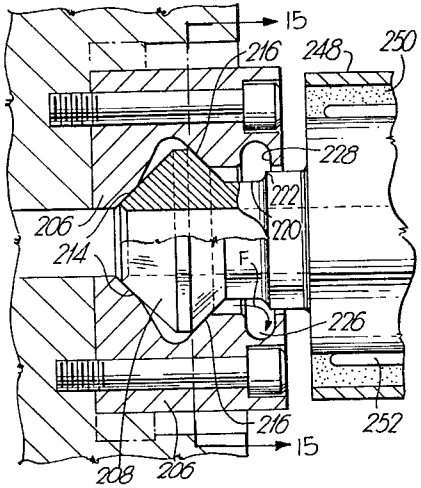
Figure 15:
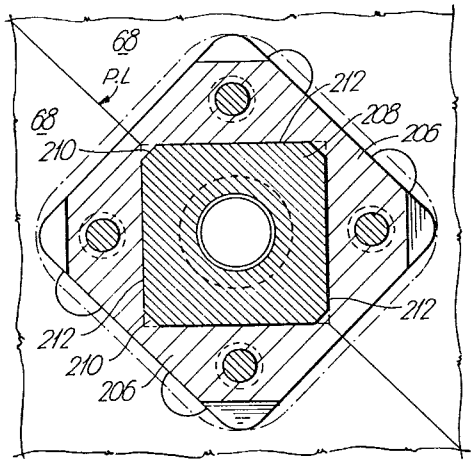
Figure 17:
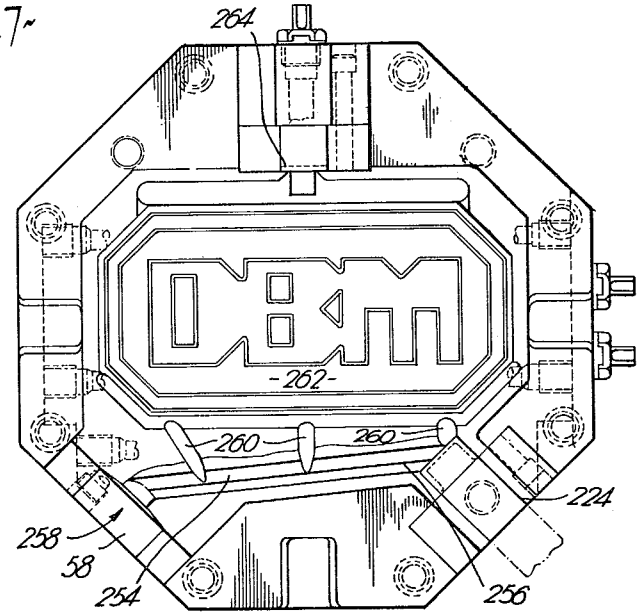
Figures 18, 19:
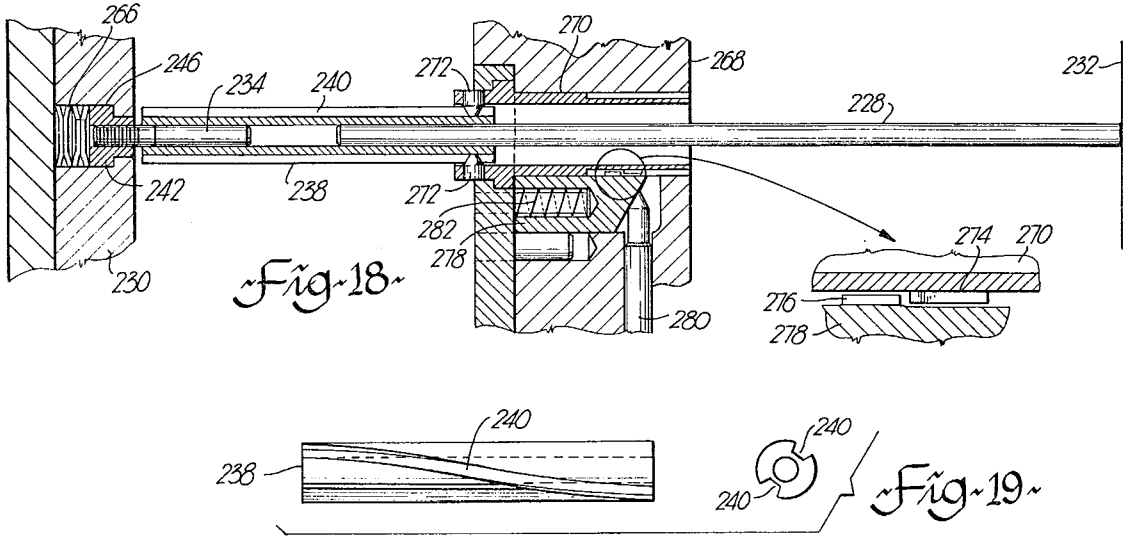
Figure 20:
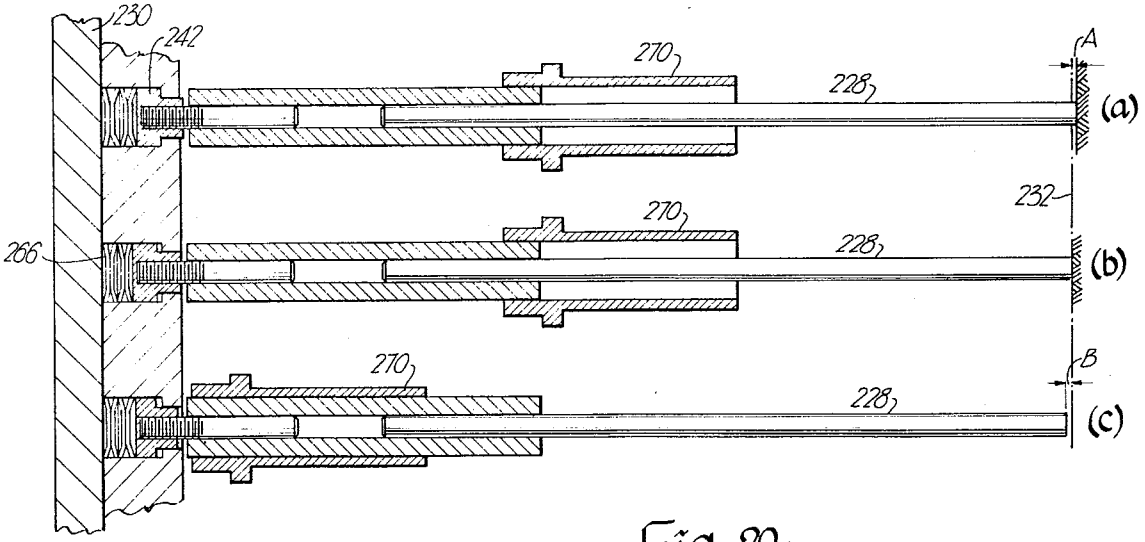
Figure 21:
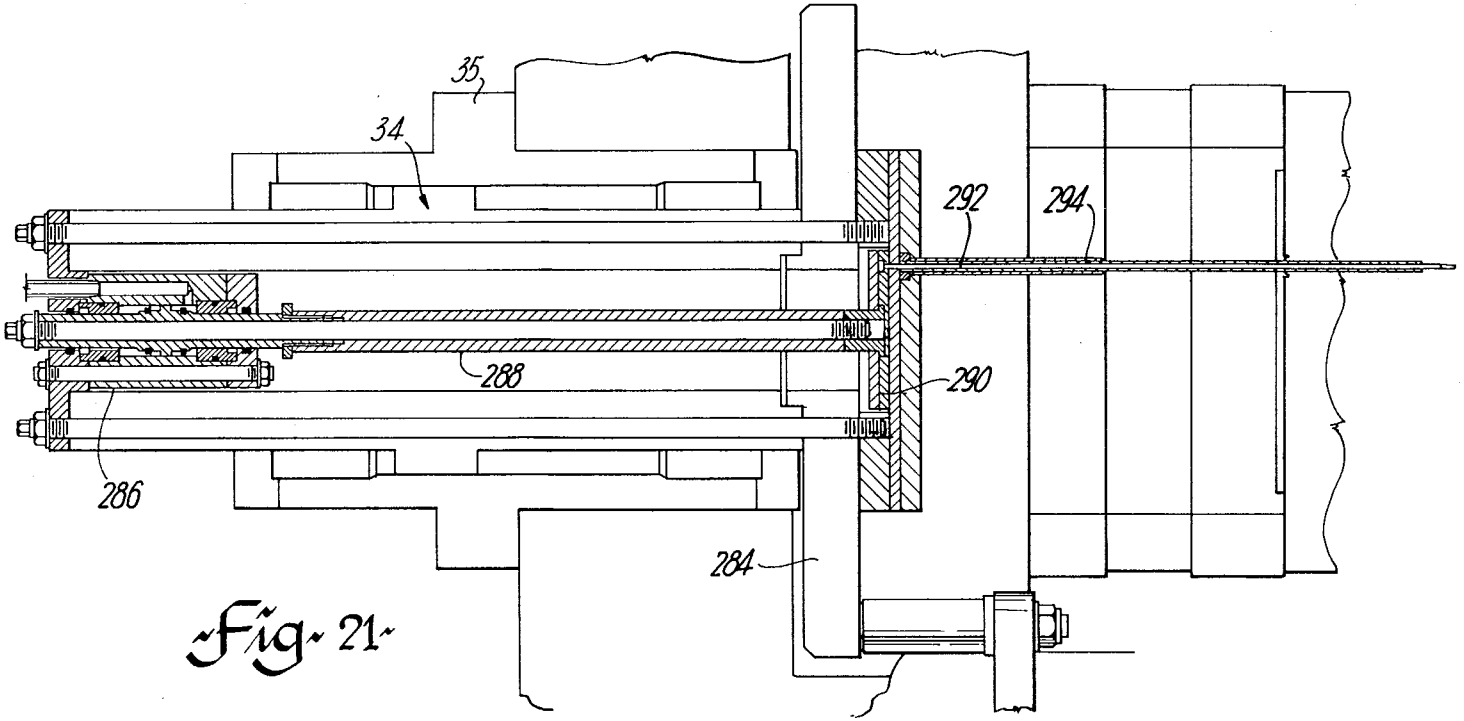
Figure 22:
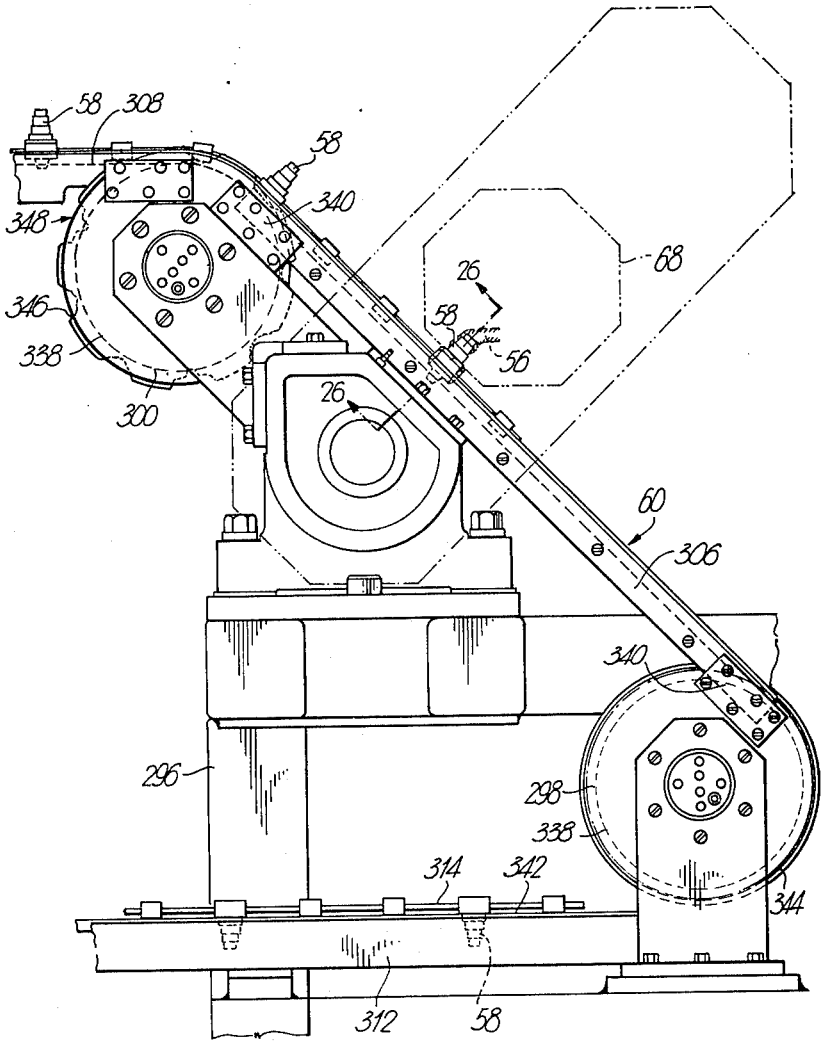
Figure 23:
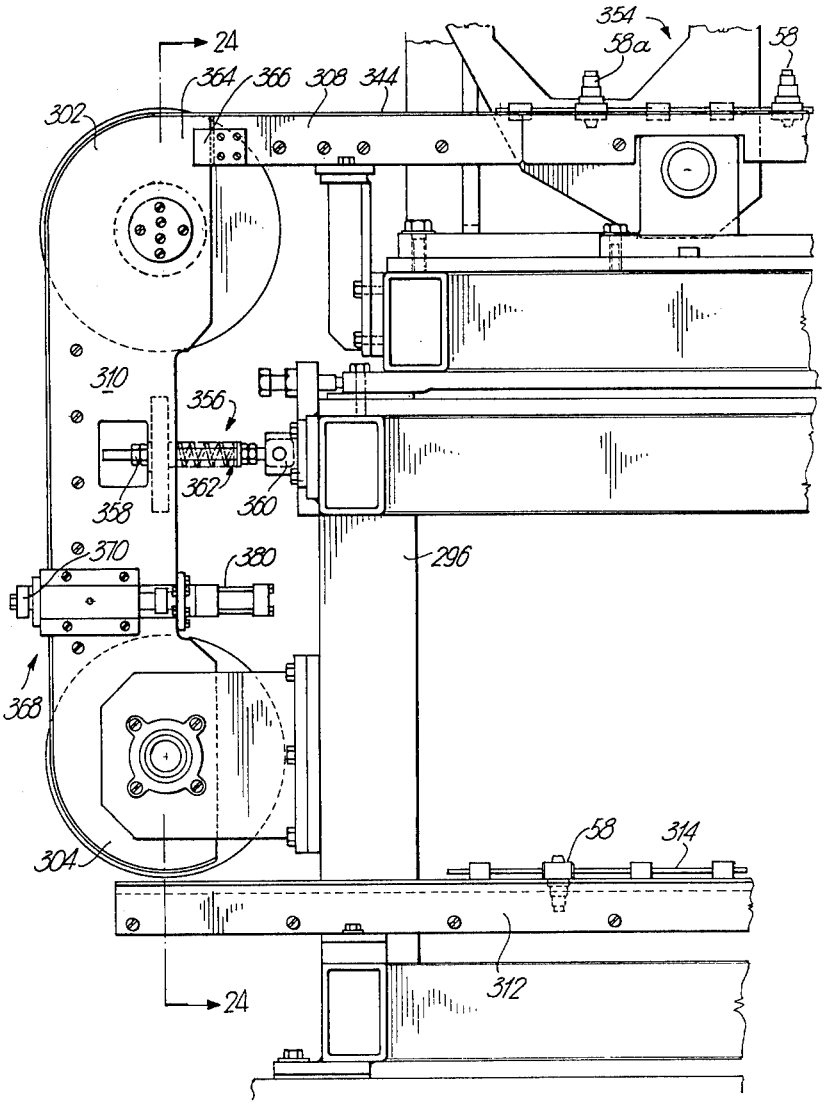
Figure 24:
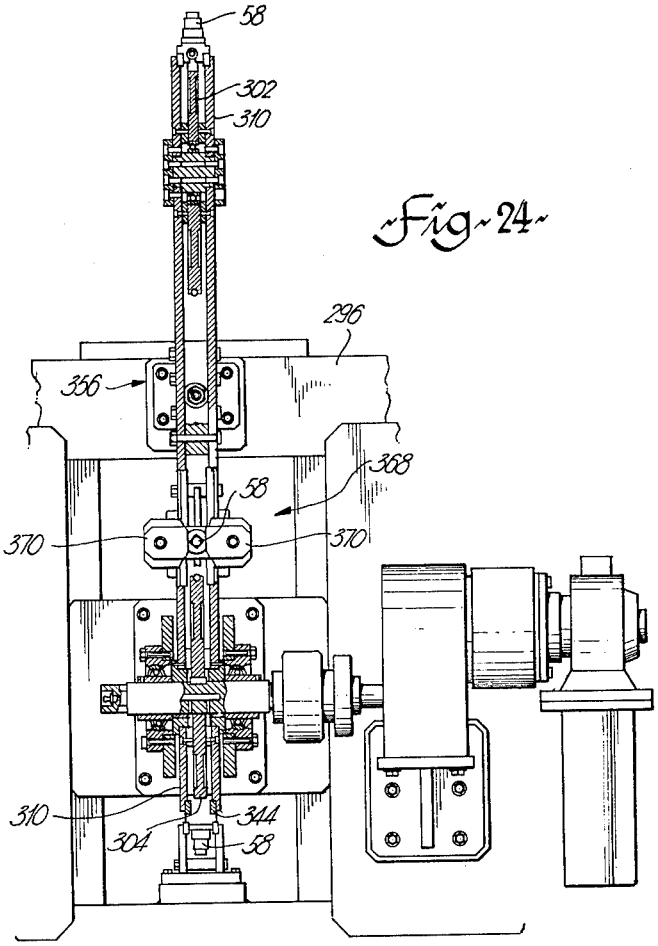
Figure 25:
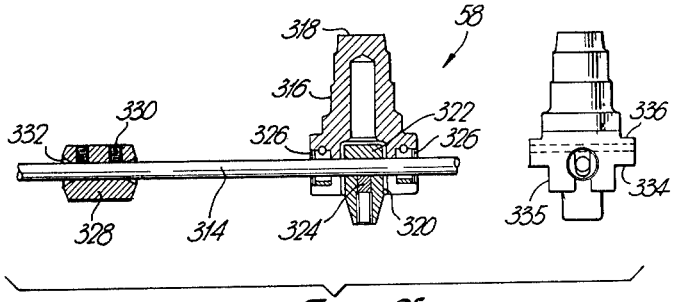
Figure 26:
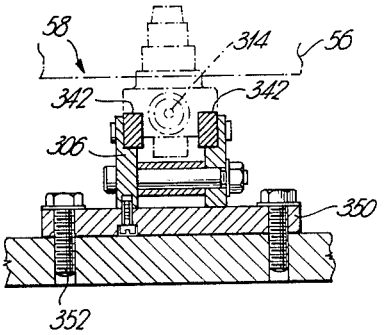
Figure 27:
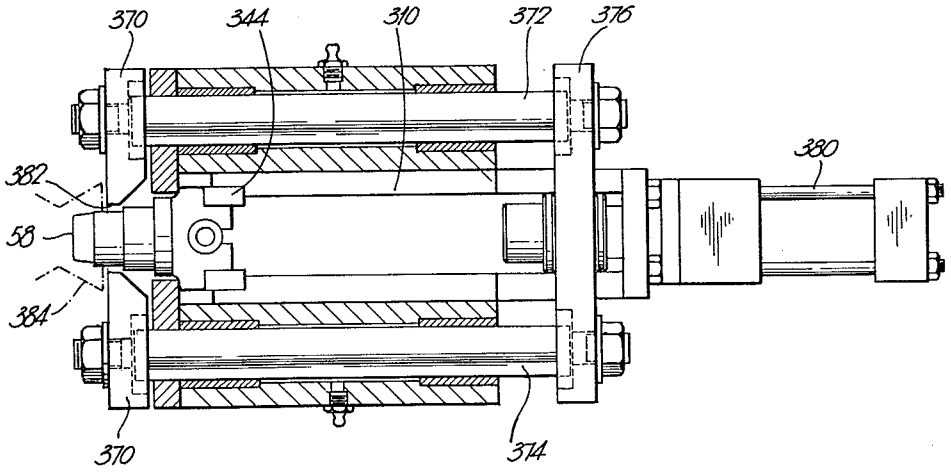
Figure 28:
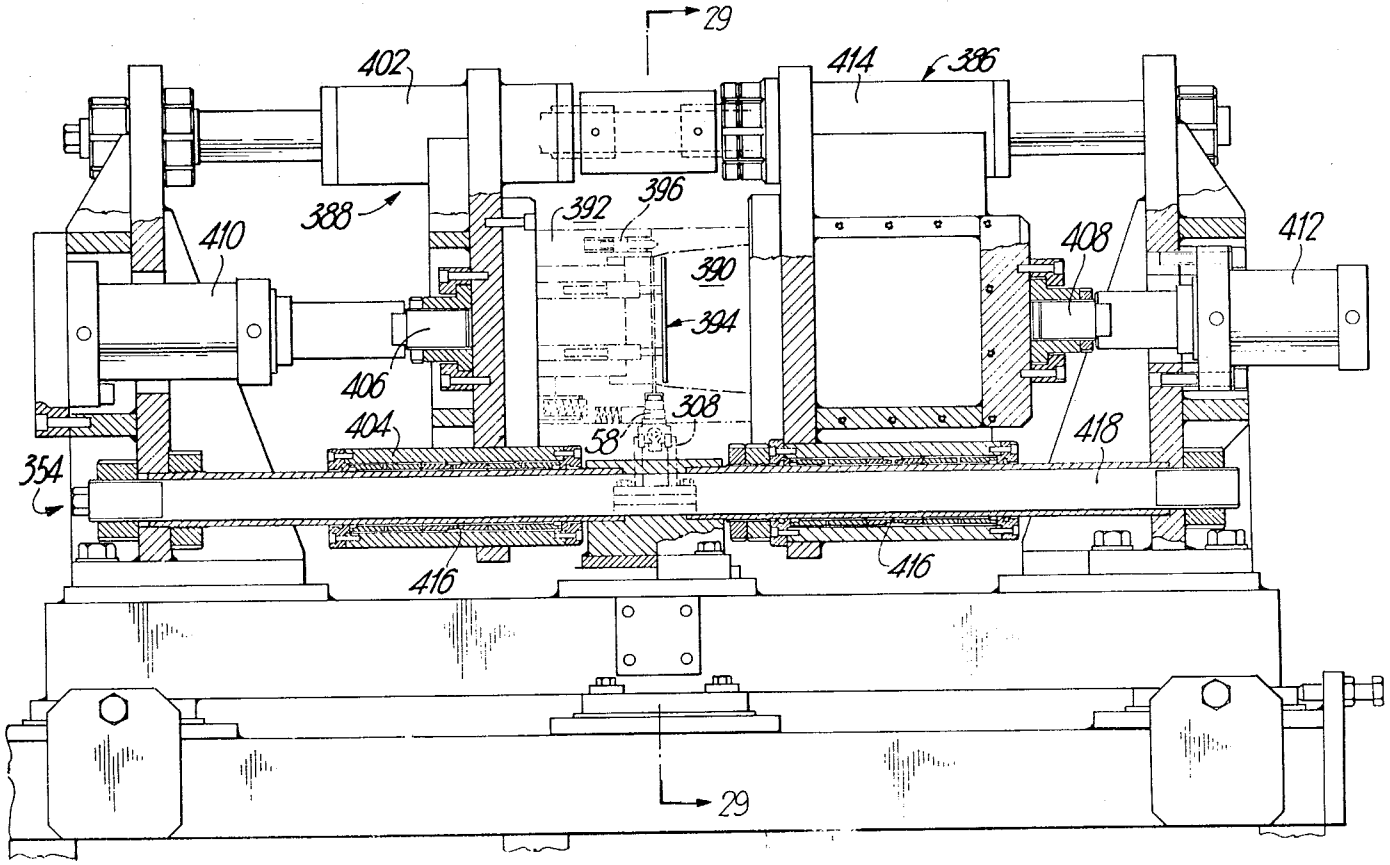
Figure 29:
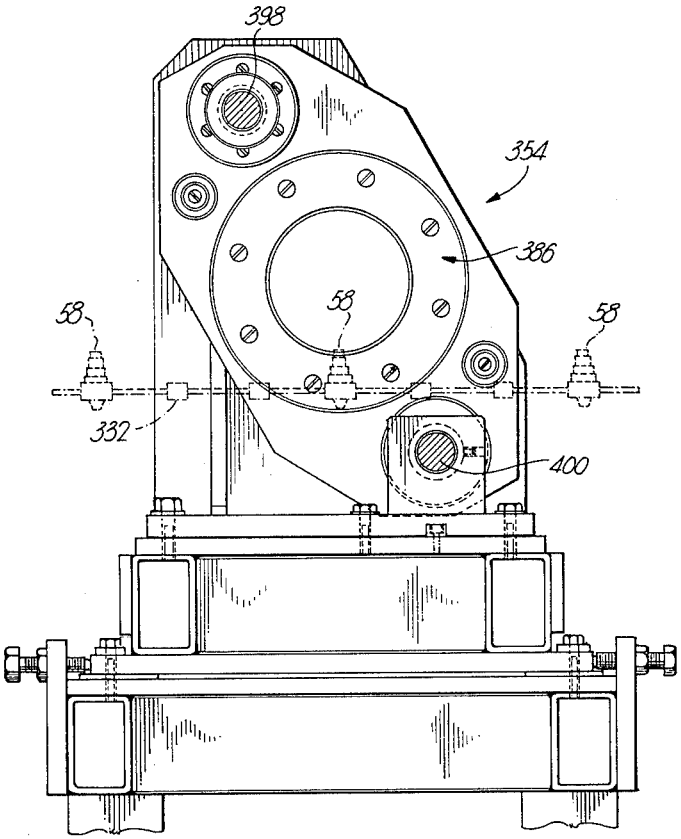

FIGS. 13 and 14 are concept illustrations of the nozzle arrangement of the invention;

FIGS. 15 and 16 are views of a preferred nozzle arrangement;

FIG. 17 is an elevation view of a typical mold cavity;

FIG. 18 is a cross sectional view of the rotary ejection mechanism;

FIG. 19 illustrates the cam and follower of the rotary ejection;

FIGS. 20 *a, b* and *c* show various positions of the rotary ejection during its operation;

FIG. 21 is a cross sectional view showing the core pin withdrawal system;

FIG. 22 is an elevation view of one end of the part transfer mechanism;

FIG. 23 is an elevation view of another end of the transfer mechanism;

FIG. 24 is a cross sectional view taken along the line 24—24 of FIG. 23;

FIG. 25 is a sectional view of the transfer finger;

FIG. 26 is a cross sectional view taken along the line 26—26 of FIG. 25;

FIG. 27 is a sectional view of the kicker mechanism;

FIG. 28 is an elevation view partly in cross section of the trimming apparatus; and FIG. 29 is a cross sectional view taken along the line 29—29 of FIG. 28.

Figure 31:
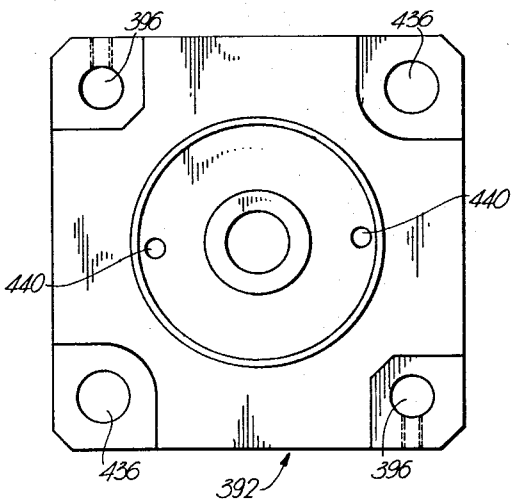
Figure 30:
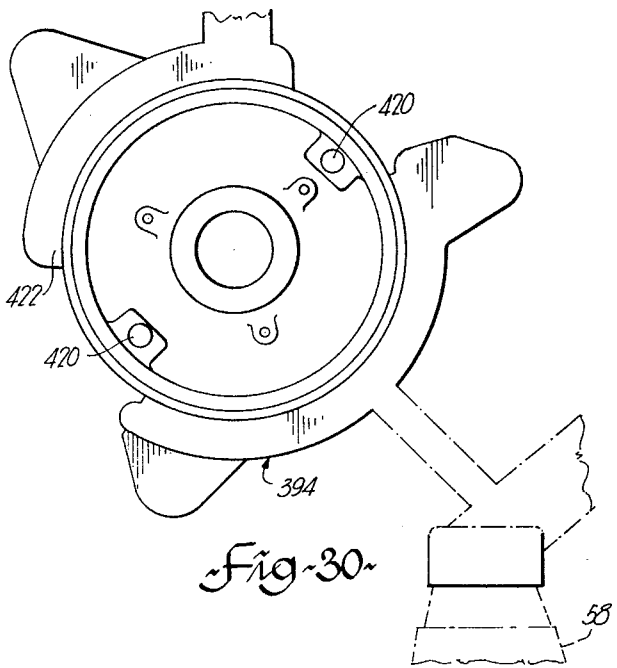

FIG. 30 is an elevation view of a cast part as it enters the trimming apparatus;

FIG. 31 is a plan view of a punch of the trimming apparatus, and

Figure 32:
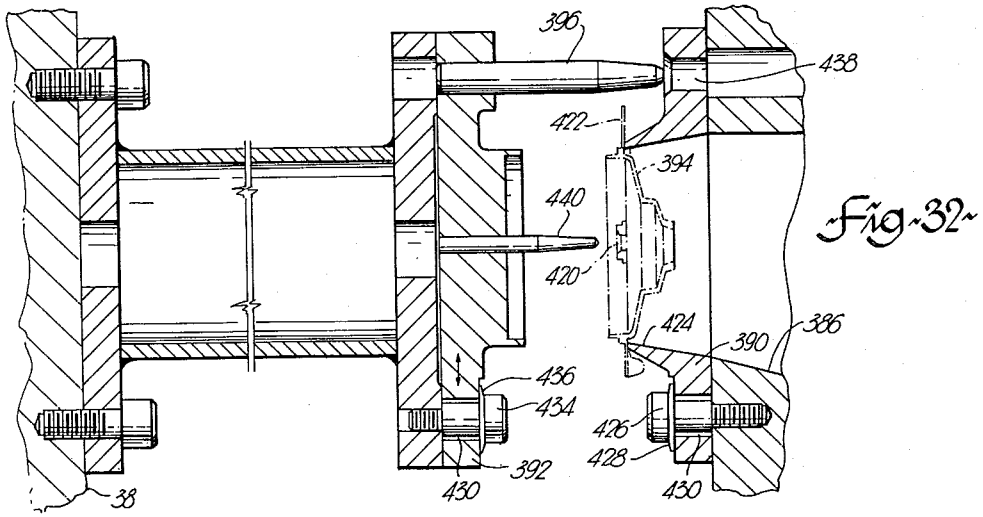

FIG. 32 is a sectional view of the punch and die of the trimmer.

GENERAL DESCRIPTION

Figure 1:
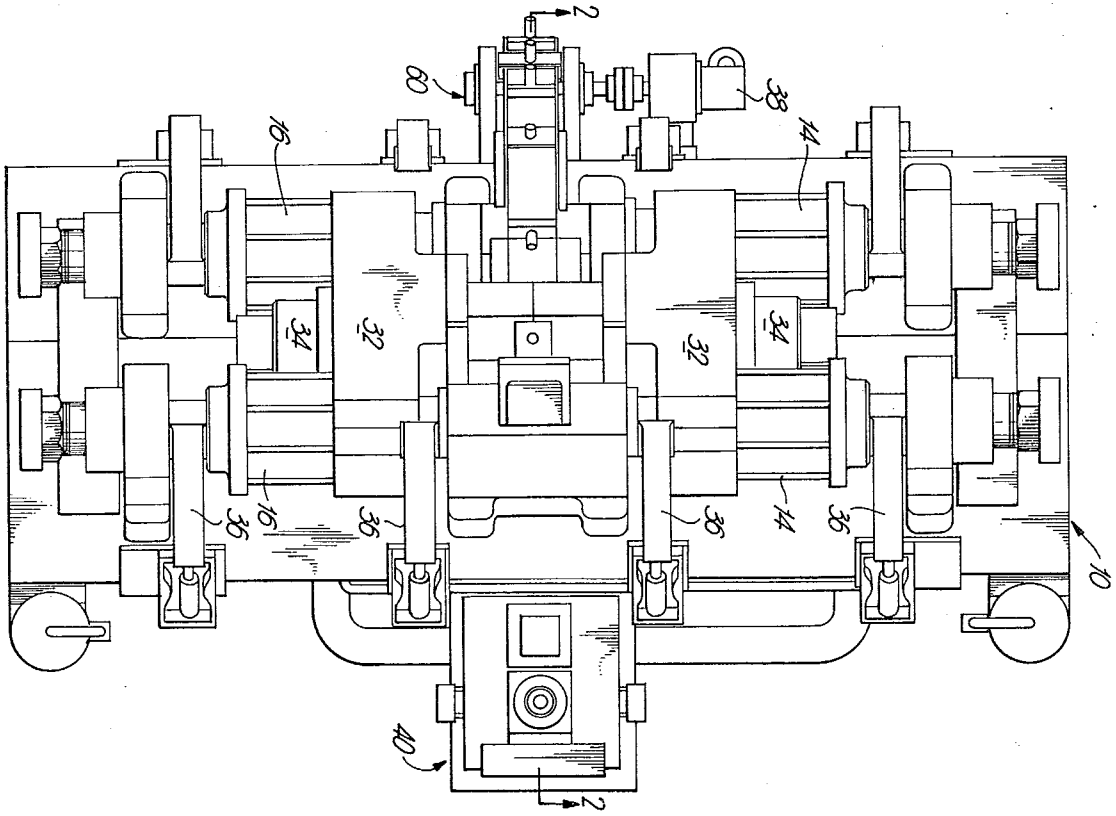
FIG. 1 is a plan view of the die casting machine.
Figure 2:
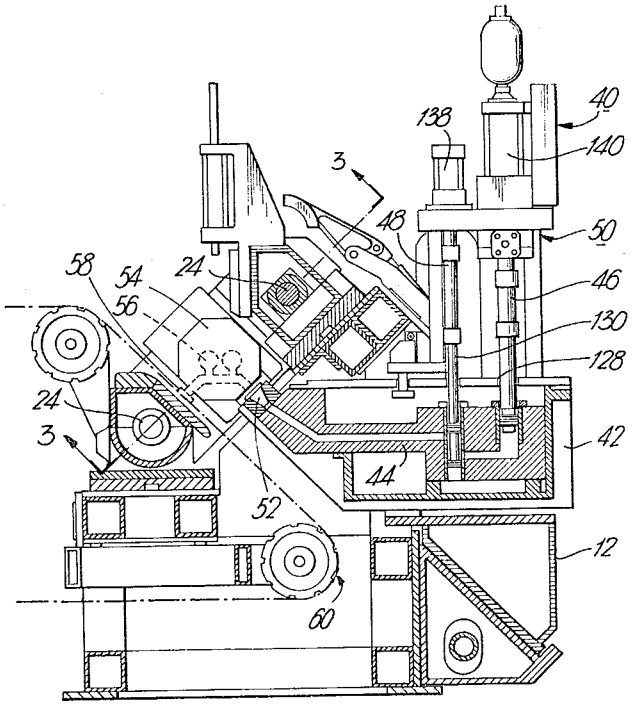
FIG. 2 is a cross-sectional view of the machine taken along the line 2—2 of FIG. 1.
Figure 3:
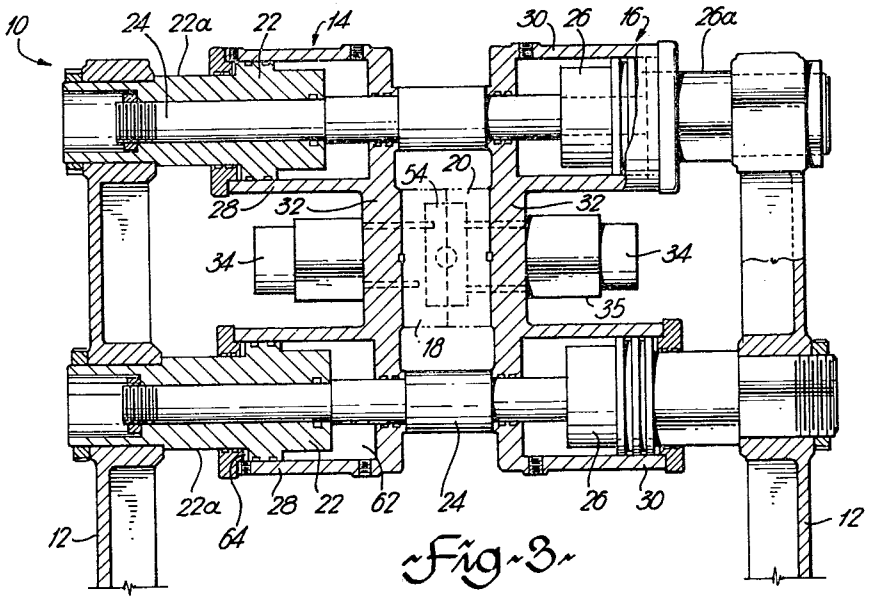
FIG. 3 is a schematic, cross-sectional view taken along the line 3—3 of FIG. 2.

Referring to FIGS. 1–3 a die casting system according to the invention includes a die casting machine 10 having a frame 12 with two pairs of spaced, parallel cylinder assemblies 14, 16 mounted thereon. Each pair of assemblies 14 support a mold half 18, as shown in FIG. 3, and is opposed to the other pair of assemblies 16 which carries the other mold half 20. As seen best in the general layout of FIG. 3, each cylinder assembly of each pair comprises a stationary piston 22 secured to the frame 12, a piston shaft 24 secured coaxially at one end to, and axially aligned with the piston 22, the shaft 24 extending across the centre of the machine to a connection at its other end with an opposed piston 26 of the other cylinder assembly 16.

As illustrated in FIG. 3, each cylinder assembly 14, 16 comprises cylinders 28, 30 respectively mounted on the pistons 22, 26 and shafts 24 for reciprocal movement of the cylinders thereon in response to hydraulic fluid injected on the crown or skirt ends 62, 64 respectively of the pistons whereby the assemblies 14, 16 and their associated mold halves are moved to open or closed (as shown) positions.

A more detailed description of the basic concept of the machine 10 may be had from the disclosure of U.S. Pat. No. 4,013,116.

Turning to FIG. 1, a plan view of the machine 10 shows the mold clamping cylinders 14, 16, platens 32, die separation and ejection cylinders 34, interference blocks 36 for preventing accidental cylinder movement and the drive means 38 for the transfer mechanism.

FIG. 2 illustrates the injector assembly 40 comprising the furnace 42 gooseneck 44 with shot and selector valves 46, 48; and shot valve locking system 50. Nozzle 52 directs the zinc shot into the mold 54 to provide a casting 56 that is cast onto a carrier finger 58 on the transfer mechanism 60 that transports the cast part to a trimming station.

A die casting machine requires only a small, nominal force to advance the molds to their closed position shown in FIG. 3 but this must be followed by a strong clamping force to retain high internal pressures developed in the mold when the casting metal is injected therein. Therefore, a cylinder large enough to clamp the die would require an excess volume to fill it during the closing stroke. As seen in FIGS. 1–3, the machine of the present invention is of the two-tie bar type with each end of the two shafts 24 extending through the hollow centre of the two stationary pistons 22, 26 on each side of the machine. As seen in FIG. 3, the pistons have rod extensions 22*a* and 26*a* on their skirt ends but the extensions are of a smaller diameter than the crown ends of the pistons and therefore form a slightly different pressure area at each end of the surrounding cylinders 28, 30 which are the moving members and which are integral with the machine platens 32 on each side of the machine centre. Accordingly, by pressurizing both the crown end 62 and skirt end 64 of each cylinder and providing an internal flow passage from the smaller pressure area 64 to the larger 62, the fluid volume that is required for a cylinder stroke in one direction is only the difference between the two areas 62, 64, times the stroke. When closed as in FIG. 3, the pressure to the smaller area 64 is dumped to tank allowing all the force on the larger area 62 to clamp the die closed.

The above described system works only for die closing and therefore the ejector cylinder 34 is used for die opening. Cylinder 34 is also of a double-rod type utilizing a relatively small net force area and thus requiring a minimal hydraulic flow volume. Cylinder 34 pushes against fixed outer stops 35, FIG. 3, to open the machine and subsequently retracts to withdraw a stripper pin plate (FIG. 21). We have found that substantial saving in fluid volume is realized from this system.

HEAT TRANSFER

Die casting in a permanent mold involves the process of transferring heat from a molten metal alloy to the walls of the die cavity and from the cavity to a heat exchange medium. Accordingly, certain specific parameters must be maintained to attain the heat flow rate desired.

In the system of the present invention, the heat exchange medium is water and electric immersion heaters are used only to preheat the die to operating temperature and thereafter the temperatures above the boiling point of water are reached by controlling the internal pressure of the die cooling cavity, the actual heat removal being accomplished by evaporation of the water as it flows through the system in a metered quantity.

Figure 4:
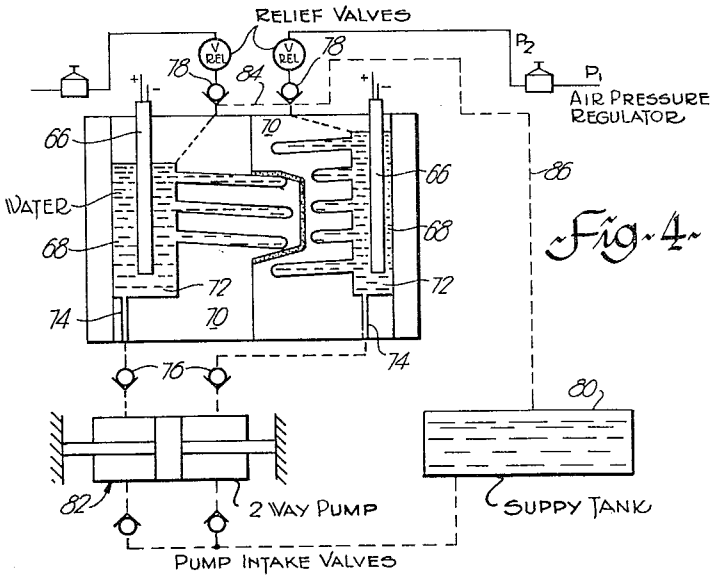
FIG. 4 is a schematic layout of the heat transfer system for cooling the dies of the machine.

The system is shown schematically in FIG. 4 which shows immersion heaters 66 situated in the mold manifold 68 adjacent the cavity face 70 and where they preheat the die to operating temperature, say 400° F. The water passages 72 in which the heaters are immersed are in communication with cooling passageways 74 which interconnect inlet and outlet valves 76, 78 respectively.

The surface area in the die cavity that is exposed to the molten metal casting alloy is in proportion to the area of cooling surface exposed to the water and the distance between the two surfaces is sized according to the heat-transfer rate of the die cavity material.

The heat transfer from the die block to the water is by evaporative cooling only. The temperature of the water within the cooling passages 72 of the die is maintained at an elevated point which is conductive to making good casting finishes during the metal injection. Subsequently, when the part is cast the excess heat is carried away as boiling occurs only where an overtemperature condition exists. Therefore, no circulation or flow of water is required within the die passages 72. As steam is generated in direct proportion to the heat removed from the molten metal it is only necessary to inject a make-up water volume slightly in excess of the steam escaping through the pressure relief valve 78.

As shown schematically in FIG. 4, water from a holding tank 80 is injected by pump means 82 into the cooling passage 72 through the inlet valve 76 at a pressure slightly in excess of the water being evaporated. As the heat transferred to the passages 72 from the die 70 cause the water in the passageway 72 to boil, the valve 78 opens under the pressure of the steam to allow it to escape via a manifold passageway 84 and line 86 where the steam condenses and returns to the tank 80.

It will be appreciated that the heat transfer system is an integral part of the mold design and function and provides for precision flow adjustment built for and adaptable in design to a variety of mold requirements. It completely eliminates the use of hose attachments and has the feature of flow adjustment retention from one run to the next.

METAL INJECTION UNIT

The metal injection unit of the present invention, indicated at 40 in FIG. 2 is different in principle in numerous ways from conventional systems and which effect both performance and safety aspects. In effect, the only similarity to conventional system is that it employs a force to drive a piston which in turn creates an hydraulic pressure to fill the mold cavity.

Figure 5:
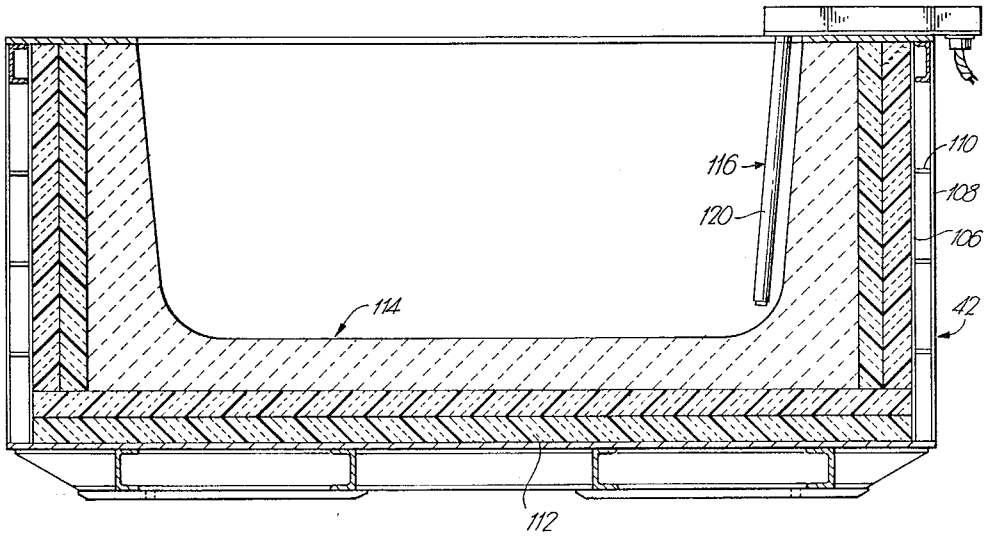
FIG. 5 is a cross sectional view of the metal supply pot and heating means.

The injection unit 40 is suspended in the supply pot 42, FIG. 5, which comprises a double steel wall construction having an inner wall 106 and outer wall 108 spaced by webs 110. This structure gives the strength effect of a continuous large H-beam to resist the internal force of the molten metal and also provide an air-space form of insulation. The interior of the pot 42 is lined with a suitable insulator such as vermiculite board 112 to which a castable refractory lining 114 is applied.

The temperature of the molten metal in the pot 42 is maintained at the desired level by a plurality of electric immersion heaters 116 (as shown also in FIG. 8*a*) spaced throughout the pot 42. Each heater 116 comprises an element 118 encased in stainless steel tubing 120 to protect the heaters against corrosion, enlarge the surface area exposed to the casting alloy and thus reduce the watt-density.

The injection of casting metal into the die cavity is effected by the injection assembly indicated generally at 40 in FIG. 2. As shown in detail in FIGS. 8*a*, 8*b* and 10, the assembly 40 comprises a steel body 122 suspended within the confines of the furnace pot 42 by means of arms 88 which support the crown 90 of the assembly from the machine frame 12, the crown 90 being connected to the body 122 by long studs 92.

The body 122 incorporates a large diameter cylinder 124 to accommodate the piston 128 of the shot valve assembly 46 and a small diameter cylinder 126 to accommodate the valve 130 of the selector assembly 48.

Figure 7:
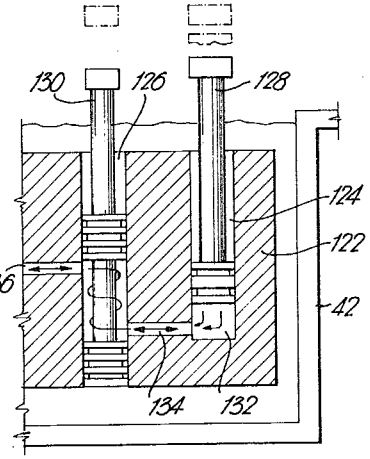
FIGS. 6 and 7 are schematic illustrations of the metal injection.
Figure 6:
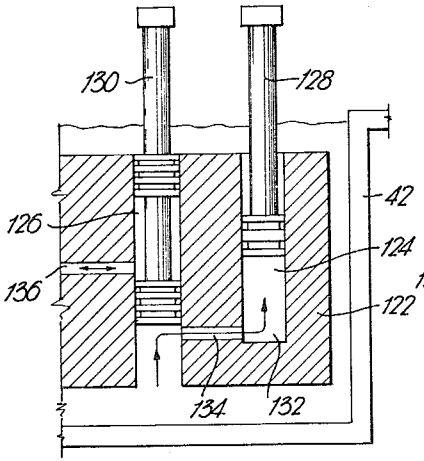

As shown conceptually in FIGS. 6 and 7, piston 128 intensifies the pressure of casting metal going to the die and valve 130, depending on its vertical positioning, selects a flow path from the pot supply to fill the pressure intensifier chamber 132 at the bottom of cylinder 125 (FIG. 6) or selects a flow path to the die from the piston 128 (FIG. 7).

Chamber 132 is connected to the selector cylinder 126 by a passageway 134 and conduit 136 in the gooseneck 44.

As shown in large scale in FIG. 9, selector valve 130 has an upper head 100 and a lower head 102 interconnected by a stem 104 of reduced diameter. Upper head 100 mates with valve seat 140 and lower head mates with seat 142, depending on the operative mode. It will be noted that the spindle has upper and lower arms 144, 146, which slidably engage the portions of the cylinder 126, thereby leaving ample room between the cylinder wall and the spindle body for passage of casting metal thereby.

During the interval between machine cycles, selector valve 130 is maintained in its shut-off position to the nozzle conduit 136 but open to the pot 42. This position would be that at the top of its stroke "S" with head 100 engaging seat 140, or the "hold and refill" position indicated in phantom line in FIG. 9. In this shut-off position, valve 130 constitutes a positive safeguard against accidental flow to the machine nozzle. At the next cycle—sequence signal, the valve 130 is shifted to its bottom position shown in FIG. 9 and the shot mode, arrow A, is ready.

Valve 130 is vertically actuated by a ram 148 connected to the valve through a frame comprising a piston rod 150 secured to a frame made up of upper and lower horizontal cross arms 152, 154 and vertical arms 156.

The shot cylinder 96 and in particular piston 94 therein is actuated by an external supply, infinitely variable pneumatic pressure volumetrically sized to the underside of piston 94. Briefly, the shot cylinder 124 is cycled so as to fill the mold cavity and instantaneously withdraw the pressure. Because the gate thickness of a casting mold is thinner than the casting cross-section, the gate thickness is the first to solidify and does so in a fraction of a second. Therefore, an instantaneous reversal of the pressure does no harm to the casting but does permit the unsolidified metal in the large inlet runner sections to drain out and thereby leave only a slush-molded tubular runner section attached to the part, as will be illustrated further on. There are several advantages to this runner-drain principle of operation. First, valuable cycle time is not lost waiting for heavy runner sections to solidify. Secondly, the tubular section of the casting is very strong and provides a light frame for transfer of the part out of the mold; the runner and part emerge at the same temperature which favors dimensional stability prior to trimming; much less heat is imparted to the runner area of the mold and the hollow runners cost less to remelt. Also, the casting metal drained from the runner is held at a point just inside the nozzle tip thus minimizing the volume of air to be expelled from the mold cavity.

Turning to FIG. 8*a*, piston 128 is shown at its maximum shot position at the bottom of its stroke "S" of the ram rod 96. When a casting is completely filled, piston 128 will stop, the flow of molten metal having passed through the open port of valve 130, arrow A, FIG. 9. A fraction of a second after the injection is completed and the casting gates are solidified, piston 128 is displaced upward by pressure on the underside of piston 94. This supply is volumetrically equal to the amount of metal contained in the runner system of the casting die to a point just inside of the nozzle tip. At this moment, piston 128 is arrested in its upward movement long enough for selector valve 130 to shift and hold the column of metal in the nozzle and gooseneck conduit 136 in a static position and simultaneously open the valve 130 to the "hold and refill" position of FIG. 9 so that there is communication from the supply in the pot 42 into the chamber 132. Piston 128 is then signaled to return to its topmost position enabling the cylinder 124 to fill.

A pressure accumulator may be provided for the shot cylinder 98 to include a variable pressure pneumatic pre-charge system to provide a constant source of pressure to the cylinder 98 but being infinitely variable as required for the particular casting being made. A casting shot is made when the opposing hydraulic pressure is released to drain and the piston 94 is returned to its starting position of FIG. 8*a* when the hydraulic pressure is re-applied. However, the first movement of the shot-return action is accomplished by an auxiliary hydraulic displacement cylinder having an adjustable stroke to inject a controlled amount of fluid into the shot-return circuit. This action serves to withdraw the shot piston 128 and in turn provides space for the unsolidified casting metal in the runners of the die to drain out leaving a shell molded hollow section as mentioned previously.

An accumulator type receiver is provided to accept the fluid discharged from the shot cylinder. The fluid so discharged is in the order of 500 g.p.m. and the receiver subsequently discharges the fluid slowly to drain to tank during the machine cycle period.

A safety restraint or "scotch" system is shown generally at 141 in FIG. 8*a* and in detail in FIG. 12. This apparatus prevents actuation of the shot when making machine adjustments and when the 'shot' mode is not selected.

Ram rod 96 is provided with a cammed flange 143 adapted to engage and momentarily displace a pair of locking collars 145, 147 when the ram 96 and piston 94 are on their upward stroke so that flange 143 then nests in the socket 149. Collars 145, 147 are maintained in their closed position of FIG. 12 by a spring 149 and are opened against the spring pressure by the upward movement of the flange 143. Once in the socket 149, piston 94 and ram 96 cannot process downward as the closed collars engage the underside of the flange 143. As shown in FIG. 12, collars 145, 147 are pivotally mounted on pins 151 and geared together by teeth 153.

Collar 147 has a wing 155 held to the closed position by the spring 149 on a pin 156 slidably positioned in a member 157.

An actuator 158 has a rod 159 acting on the other side of wing 155. It will be appreciated that when actuator 158 displaces rod 159, collars 145 and 147 will be opened to allow the ram rod 96 to progress downwardly.

The entire injection assembly is suspended and supported by a cantilever frame made up of the arms 88 and cross plate 89 bolted to the frame 12 of the casting machine. Alignment adjustment of the assembly is accomplished by screws 160 for linear movement along the axis or centreline of the gooseneck 44, and by screws 162 for vertical and 164 for horizontal right and left movement. For alignment of the nozzle tip to the casting die in the plane of x—x, FIG. 8*b*, the ball and socket pivot 166, which is slightly loosened during the alignment procedure, permits a 3-axis movement to be made to locate the nozzle tip in line and square with the casting die.

It will be seen from FIG. 10 that cantilever arms 88 have surfaces 168, 169 which when extended to lines A and B are parallel to the centre line of the gooseneck 44. Crown 90 has shoes 170 that ride on surfaces 168 and 169 so that adjustment of the screws 160 moves the assembly linearly correct.

The sequential operation of the metal injection system is as follows.

A signal from the mold clamping action causes the slot selector valve 130 to move to its downward position of FIG. 9 and thereby contact a positional sensor.

The positional sensor in turn signals the restraint system to withdraw, effecting movement of the actuator 159 and releasing the collars 145, 147 from the ram flange 143.

The restraint sensor gives signals to activate the metal injection shot piston 94 and to initiate a timer which signals the partial retract system after a fraction of a second delay to give time for the metal in the mold gates to solidify and thereafter drain out the runner cores. At the completion of the time delay the shot selector valve 130 returns to its upward position.

The up position of selector valve 130 then signals the shot cylinder 94 to return to its top position and again the restraint system moves to its locked position.

NOZZLE

As shown in FIG. 8*b* a nozzle extension is provided to bridge the distance from the pressure intensifier 128 to the casting die 54 (FIG. 2). Referring to FIG. 11, the extension includes an adjustable joint coupling indicated generally at 184 which connects the terminal end 186 of the gooseneck with the extension 188. The end 186 of the gooseneck riser is machined to provide a peripheral flange 190 and adjacent groove 192. The extension 188 terminates in a spherical end 194 and, when the end 194 and the end 186 are properly aligned the conduit 136 is completed. The two ends are held in alignment by means of a pair of clamps 196, 198 secured together by bolts 200 as shown. The clamping blocks 196, 198 are also provided with a plurality of cartridge heaters 202 to maintain the proper temperature level in the connection.

As mentioned in the preamble of the present disclosure, the die casting machine of the present invention utilizes a "parting line" injection where the entry of the molten casting metal into the die passes through the conduit 136 which is centred with the parting line of the mold and at the periphery thereof on one side. There must of course be a leak-proof fluid tight seal with the nozzle when the mold is closed and yet there must be freedom for the mold to open without dragging or sticking. With known nozzle tips of circular shape, the mold has to have two half round shapes to close about it whereby a condition exists of zero clearance angle at the parting line where the two corners of the half circle are tangent to the diameter and, since a leakproof seal requires an interference fit, it is impossible to not have some opening friction. To obviate this and other associated problems, a square, diamond shaped nozzle is utilized as shown conceptually in FIGS. 13 and 14. A similar configuration is used for the carrier finger 58 (FIG. 22) the purpose of which will be subsequently disclosed.

As shown in FIGS. 13 and 14, the mold halves 68 are provided with inserts 206 and while not illustrated, the square nozzle 204 is slightly larger than the square hole that is formed for it when the mold halves 68 are closed about the nozzle. The parting line variations in the nozzle to machine alignment might be in the area of plus or minus 0.20–0.30 inch and these dimensions are absorbed by the elastic movement of the injection assembly. The inserts provide opportunity for precision fitting of the parts concerned. It will be appreciated that all of the surfaces of the nozzle and the mold will be subject to the same unit force upon closing as well as providing a very accurate camming means to bring the two mold halves into proper alignment.

A preferred embodiment of the nozzle having a multi-faceted design is shown in FIGS. 15 and 16 where the nozzle 208 has slightly rounded or cut off corners 210 but does have flat surfaces 212 for lateral alignment by inserts 206 provided on both mold halves 68. In addition, as shown in FIG. 16 the nozzle has angulated faces 214 and 216 in side view which mate with similar faces in the mold half inserts 206 to effect the proper linear alignment.

FIG. 16 also illustrates a cross-sectional view of a flash-guard 236 which is formed by surface 220 of reduced diameter and the adjacent curved shoulder 222 in combination with the pocket 226 and its offset surface 228. If for any reason molten metal should leak under pressure from the nozzle tip, the resulting flash would follow the arrow F, being directed into the pocket 226 by the shoulder 222.

The desired temperature of the nozzle 208 is maintained by a nozzle cover 248 enclosing suitable insulation 250 which in turn surrounds electric heaters 252.

MOLD

FIG. 17 illustrates the mold of the present machine. One of the basic advantages of the present machine over the prior art is the nearly perfect thermal balance between the mold halves 68 coupled with die separation simultaneously away from the casing. In situations having no core pins and adequate draft angles, parts can be produced without any stripper pins. However, either with or without strippers the part is supported at three points around the periphery of the frame in which it is cast. These three points form a plane of reference from which the part is subsequently transferred out of the machine. As shown in FIG. 17, the nozzle has made a casting in the mold and the inlet runner 254 extends between the gate area 256 and that portion of the mold 258 which will provide a casting around the transfer finger 58 shown in FIG. 22. Further gates 260 extend from the inlet runner into the casting proper 262 (in this case a logo DBM and frame therearound) and an outlet runner extends upwardly to surround a top core slide 264. Therefore when the die halves 68 are simultaneously separated the casting is held by (a) the top core slide 264, (b) the nozzle entry 256, and (c) the transfer finger 258, the part 262 subsequently being transferred out of the machine by finger 58 as will be subsequently described in relation to FIG. 22. In addition, when the top supporting core 264 becomes a core for forming a section of the casting, it also serves as the third point of support during opening of the dies and virtually eliminates the need for any stripper pins.

EJECTOR PIN RELEASE AND RETRACT MECHANISM

In conventional die casting machines the cast part usually follows the ejector half of the mold as it pulls away from the cover half. Then, upon nearing the end of the opening strokes, ejector pins extend and push the part away from the mold face. In order to ensure that the part is released from the pin faces a further device is used to disturb its tendency to stick on the pins and this device is commonly called a "quick ejector" and it actually tips the part out of the original working plane.

A "quick ejector" arrangement cannot be used with the machine of the present invention as the part must be retained in its original working plane. Additionally, the part must be held in a fixed plane as both halves of the mold are opening. Accordingly, the die casting machine of the present invention requires a completely different type of part ejection device to loosen the part from the mold and hold it in this desired, fixed position. Therefore, means are provided to both loosen and retract the pins to leave the part retained at the centre line of the machine and attached to the carry-out finger 58 at one edge and the nozzle impression at the other.

FIG. 18 is a cross-sectional view of the ejector plate and its associated mechanism for rotating the ejector pins. Such mechanism is provided from both sides of the cavity.

The ejector pin 228 is mounted at one end in the ejector plate 230 and extends through to the die face 232. To this end, the pin 228 has an extension piece 234 secured in coaxial alignment with pin 228 by means of a tube 238 having a pair of helical channels 240 formed therein as shown in FIG. 19. Pin 228 and extension 234 are welded to the tube 238 and its free end is threadably engaged in a bushing 242 yieldably mounted against rotation in a pocket 246 under pressure of bellville washers 266.

The mold plate 268 is provided with a shouldered sleeve 270 having a pair of diametrically opposed pin followers 272 thereon and which ride in the helical channels 240 as shown in FIG. 18. Sleeve 270 is provided with a spline 274 (see inset) which engages a spline 276 on a tubular spring lock 278 when a release pin 280 is retracted.

As the machine closes the mold halves together, pin 228 is in the position of FIG. 20*a*, its terminal end extending just beyond the die parting line. As the molds close, FIG. 20*b*, pin 228 is linearly retracted against washers 266, under pressure of about 300 lbs. Release pin is retracted allowing spring 282 to slide lock 278 forwardly, engaging the splines 274, 276, preventing rotation of sleeve 270. As the mold plate 268 is pulled back towards the position of FIG. 20*c*, the follower pins 272, acting in the channels 240, rotate the tube 238 and pin 228, the extension 234 threading itself into bushing 242. When the plate 268 reaches the position of FIG. 20*c*, the pin is then linearly retracted against the washers 266 to about a 400 lb. load, pulling the pin 228 back from the casting by a distance "B", about 0.008 inch.

Returning the plate 268 to its closing position of FIG. 20*a* the tube 238 is rotated back to its FIG. 18 position, release 280 disengaging the splines 274, 276.

Rotation of the pin face in relation to the casting disturbs its attachment thereto caused by the pressure of the casting process. Secondly, as shown in FIG. 20, it withdraws the pin a precise distance depending upon the chosen design of the helix 240 on the tube 238. Thus, pin 228 is both loosened and withdrawn leaving the cast part completely free but still contained within the small clearance between pins extending from both halves of the mold.

CORE PIN WITHDRAWAL

Means are provided for primary core pin withdrawal prior to opening of the die and immediately following the solidus condition of the cast metal. This permits a true stripping action without distortion of the casting as well as for less strain on the core pin itself because the casting has not had time to cool and shrink tight around the core. As cores are to have at least 0.0005 inch per inch taper per side it is only necessary to withdraw the core enough to exceed the amount of casting shrinkage during the brief interval between the solidus time and withdrawal time. The advantage is significant in respect to scrap reduction, pin breakage and lack of distortion in the casting because the cores are entirely free of the casting when the die is open.

Referring to FIG. 21, the machine ejector plate 284 supports an air cylinder 286 which linearly actuates a rod 288 that is coupled at its terminal end to further plates 290 that retain a plurality of core pins (only 1 of which is shown), each core pin being positioned within a tubular stripper pin 294. Actuation of air cylinder 286 serves to advance or retract piston rod 288, plates 290 and pin 292 within the stripper 294.

TRANSFER MECHANISM

As indicated generally in FIG. 2, the finger 58 of the part transfer mechanism 60 carries the cast part from the die cavity to secondary operations such as trimming. When a part is cast from molten metal in a permanent mold it must remain in the mold after solidification for a long enough period to attain sufficient strength to be self supporting from its own weight. However it is of course also desirable to open the mold as soon as possible in the interest of a short cycle time and to minimize shrinkage onto the male cores. In practice, the casting emerges several hundred degrees above ambient temperature and if cooled by the conventional practice of water quenching, severe strains are built up in the part which can make it dimensionally unstable, particularly in regions where heavy sections are adjacent to thin sections.

In the system according to the present invention, a conveyor is provided which transfers the part which has been cast onto a finger 58 out of the mold 60 and through a sequence of indexes until it has been air cooled slowly to near ambient temperature. The slow cooling greatly reduces strain in the part and presents it to secondary machining operations with greater accuracy.

In the illustrated embodiment of the present invention the cast part is transferred from the molds 60 to a trimming operation, FIG. 22 illustrating the "casting" end of the transfer mechanism and FIG. 23 illustrating the "trimming" end of the transfer mechanism.

Referring to FIGS. 22 and 23, the transfer mechanism generally indicated at 60 comprises a frame 296 which carries sprockets 298 and 300 on the casting end of the mechanism and sprockets 302 and 304 on the trimming end. The sprockets are interconnected with upper run side plates 306, 308, sprockets 302 and 304 having their own side plates 310 for a purpose which will be described. Other side plates 312 are provided between but are not connected with sprockets 304 and 298 for the return lower run of the transfer mechanism.

As shown clearly in FIGS. 25 and 26, a multi-strand wire cable 314 is provided around the sprockets and cable 314 has much greater tensile strength than is required for the working load. Cable 314 forms the basis of the transfer system 60 and to that end is provided with a plurality of metal fingers 58 which are loosely attached to the cable 314 to carry the casting 56 from the mold 68. As described in relation to FIG. 17, the casting or "part shot" consists of the casting supported within the frame which includes the metal inlet runners 254 and 260, the part 262 and the gates, overflows stripper pads etc. and the socket end 258 which is cast onto the conveyor transfer finger 58 as well as the socket 264 which may be cast onto the centre mold. As shown in FIGS. 25 and 26, finger 58 consists of an upper body member 316 terminating in a square, diamond shape tapered end 318. Body 318 has a lower socket 320 for the reception of plug 322 which is detachably secured to the cable 314 by a set screw 324. Plug 322 locates the body of the finger on the cable which is attached thereto by end retainers 326. It will be seen from FIG. 25 that there is sufficient clearance provided between the interior socket of the finger and the plug 322 to provide for finger movement. The cable 314 is also provided with a plurality of links 328 which are movably secured to the cable by set screws 330, each end of the link 328 having a tapered bore 332 to allow for flexibility in cable movement when training the links around the sprockets of the mechanism.

It will also be noted from the full view of the finger 58 in the right-hand portion of FIG. 25 that the body member 316 has flat portions providing lower and upper track engaging shoulders 334 and 336 respectively, the function of which will subsequently be described.

The sprockets 298 and 300 are rotatably mounted within side plates 338 which in turn are interconnected to the side rails 306 by connecting plates 340 so that the plates 338 and side rails 306 are co-planar and co-extensive with respect to one another. Additionally, the side rails 306 support spaced track members 342 as shown in FIG. 26 and which support the finger 58 and specifically the shoulders 334 thereof. It will be noted that the track members 342 are speced to receive the side surfaces 335 of fingers 58 as shown in the right hand side of FIG. 25 and FIG. 26. Moreover, the sprockets also include an arcuate member 344 which is co-extensive with the track member 342 on the rails 306 so that the finger 58 and spacers 328 is continuous both in the straight sections and around curves so as not to present any shear points or wedge entries where debris could be trapped and stop the indexing movement.

It will also be seen from the bottom portion of FIG. 22 that on its return run, the cable 314 carries the figure 58 along the lower run 312 where the upper shoulders 336 of the finger engage track members 342.

It will also be noted from the upper left hand portion of FIG. 22 that sprocket 300 has spaced indentations 346 to receive and drive the spacers 328 and further indentations 348 which are provided with contours to receive and drive the lower shapes of the fingers 58.

As seen in FIG. 26, rail 306 is secured to the frame 12 of the die casting machine by means of a plate 350 and cap screws 352.

Looking now at FIG. 23, the finger 58*a* which would carry a cast part is indexed along the upper run 308 of the track to its position at a trimming mechanism as shown generally at 354 and after the trimming operation, the cable 314 draws the finger over sprocket 302 onto track 310. Track 310 together with the sprocket 302 which it carries is pivoted about the centre of lower sprocket 304 and track 310 (which is in effect a long arm) is used as a fulcrum about the centre of sprocket 304 to maintain the cable 314 in proper tension through the action of a spring tensioning member 356 which is connected at one end 358 to the arm 310 and at its other end 360 to the frame 296 of the transfer mechanism. A take-up spring 362 applies outward pressure on the arm 310 which is allowed to pivot about the centre of a sprocket 304 through the slidable connection between the upper portion 364 of the arm between side plates 366 secured to the upper track 308. The constant load on the cable 314 also serves to maintain a constant overall length to the cable in respect to its elastic stretch properties and any minor differences in position of the fingers 58 from one to another are absorbed by the purposeful looseness of those fingers plus or minus of the position of its fixed attachment to the cable as shown in the relationship to its mounting in FIG. 25.

As the finger 58*a* is drawn along arm 310 with the frame of the casting remaining after the trimming operation, it reaches a kicker station 368 where the part-shot frame is kicked off the carrier finger 58 onto a belt conveyor (not shown) for return to the casting metal melting pot.

The kicking station shown in cross-section in FIG. 27 includes a pair of slippers 370 mounted on either side of the track or arm 310 and which are connected by bolts 372 acting in sideways 374 with a plate 376 connected to a linear actuator 380. As seen in FIG. 24, finger 58 with the remainder of the casting frame is drawn downwardly between the confines of the arcuate ends 382 of the slippers 380 which effectively lie under ears 384 on the casting as shown in FIG. 30. When finger 58 and the casting frame reaches the position of FIG. 27 by indexing, the linear actuator 380 is activated which moves the plate 376, bolts 372 and slippers 370 outwardly (to the left in FIG. 23 or FIG. 27) thereby kicking off the remainder of the cast on part which will drop down onto the conveyor and be returned to the melting pot. The finger 58 then returns to the casting end of the transfer mechanism along the lower run of track 312 as shown in FIG. 23.

TRIMMING MACHINE

Referring to FIGS. 28 and 29, the trimming machine 354 provides a location midway between the two platens for support of the transfer conveyor track 308 which carries the parts to the trim die and on through as required. In effect, as shown in FIG. 28 the trimming machine straddles the conveyor 308 and finger 58 and the part that it carries.

The concept of the trimming machine features two moving platens 386 and 388 which carry the trim die 390 that is carried on platen 386 and a trim punch 392 that is carried by platen 388. The two platens advance towards one another to close about the stationary, prepositioned casting 394 within the carrier frame. The timing of the two movements is such that the die 390 reaches its final position while the punch 392 is still advancing and accordingly it acts as a back-up to the preliminary advance of final-position locators 396 just before the punch encounters the part to shear it from the carrier frame.

The trim machine 354 is a two tie bar type with upper and lower prestressed bars 398 and 400 mounted within tubular compression members 402, 404 to provide substantial rigidity. As seen in FIG. 29, bars 398 and 400 are tilted off a vertical line to facilitate loading of the die while suspended from an overhead lift. A pair of short stroke hydraulic shock absorbers 406, 408 are positioned in 180° opposite to one another and on a plane of the machine centre line and serve to absorb the unloading shock when the punch 392 breaks through the sheared section of the part.

One form of the trimming machine utilizes a single hydraulic cylinder 410 and 412 driving each of the platens 388 and 386 respectively along the centre line of the machine axis. Another form of the machine features hydraulic cylinders 414 and 416 which operate as an integral part of the platen bearing supports which permits having an open aperture through the die platen for automatic receipt of the part as it is pushed through the die in a subsequent transfer.

The punch 392 and die 390 are self-aligning. Referring to FIG. 30, a cast part 394 has a pair of apertures 420 therein and peripheral flash 422. The part is carried by finger 58 into trimming apparatus as shown in FIG. 28. The die 390, as shown in FIG. 32, has a peripheral collar 424 which surround the part and supports it behind the flash.

Die 390 is secured to the platen 386 by a pair of cap screws 426 and spring washers 428. While only one cap screw is shown in FIG. 32, a pair of these screws are provided and are located diagonally from one another. The die 390 has a bore 430 for each cap screw 426, the diameter of the bore being slightly larger than the body of the cap screw to thereby allow limited movement of the die 390 on its mounting beneath the spring washers 428.

As shown in FIGS. 31 and 32, punch 392 is similarly mounted to a riser 432 by cap screws 434 and spring washers 436, the bore 436 being slightly larger than the diameter of the cap screws 434 to allow movement of the punch 392 on its mounting. The punch 392 and die 390 can therefore "float" on their mountings and with respect to one another.

Punch 392 is provided with a pair of diagonally positioned locator pins 396 for engagement in apertures 438 of the die 390 and platen 386. Punch 392 also includes a second pair of locating pins 440 which correspond to the apertures 420 in the part 394.

In operation, the conveyor 308 and finger 58 carry part 394 to its FIG. 28 position. The die 390 is advanced to its FIG. 32 position to support the part, the floating die adjusting to its position on the part in response to the contours thereof. The punch 392 is then advanced toward the die 390 and part 394, the apertures 420 in the part receiving the pins 440 of the punch and effecting aligning movement of the punch on its cap screws 434 so that, as the punch and die close, locators 396 will be received in apertures 438.

While the invention has been described in connection with a specific embodiment thereof and in a specific use, various modifications thereof will occur to those skilled in the art without departing from the spirit and scope of the invention as set forth in the apended claims.

The terms and expressions employed in this disclosure are used as terms of description and not of limitation and there is no intention in their use to exclude any equivalents of the features shown and described or portions thereof, but it is recognized that various modifications are possible within the scope of the invention claimed.

We claim:

1. In a die-casting system of the type comprising, in combination:

(a) die-casting machine having a frame with two pairs of spaced, parallel cylinder assemblies mounted thereon, each pair of assemblies supporting a mold half and being opposed to the other pair of assemblies carrying the other mold half, each cylinder assembly of each pair comprising (i) a stationary piston secured to the frame, (ii) a piston shaft secured to and coaxial with the piston, said shaft extending across to a connection with an opposed piston of the other pair, (iii) a cylinder mounted on the piston and shaft for reciprocal movement thereon in response to incompressible fluid injected therein on either side of said piston; (iv) means connecting said cylinder to a said mold half, whereby injection of fluid into the cylinder at the crown ends of the pistons forces the cylinders and mold halves together and injection of the fluid at the skirt ends of the pistons forces the cylinders and mold halves apart with the terminal force from opening the cylinders being taken by the piston shaft, and (v) means for deceleration of said cylinders to eliminate closing shock; the improvements comprising (b) evaporative heat control means for said mold halves including a closed cooling system in each of the mold halves with passages therein for the circulation of liquid through the molds; a fluid inlet valve associated with the passages; a make-up pump for injecting cooling liquid into the passages of the molds via said inlet valve; and a pressure responsive limiting valve associated with the passages for releasing evaporated liquid from the passages when boiling occurs therein at a predetermined pressure; and means associated with the pressure responsive limiting valve for directing condensed liquid back to a supply source thereof; and (c) a metal injection system including means for injecting metal into the molds on the parting line of said molds, and means associated with said metal injection system for subsequent drainage of unsolidified metal from said runner and a self-contained molten metal supply with heating means for said metal supply.

2. The die-casting machine of claim 1 including means for supporting a cast part in a fixed position after the mold halves have been withdrawn therefrom comprising a frame integrally cast with and connected to the part, said frame having portions cast to surround the nozzle entry, a transfer finger and a core slide to thereby support said part at three locations when the mold halves are moved away from it.

3. A die-casting machine according to claim 54 wherein said metal injection system comprises a steel body including a first cylinder having a pressure intensifying piston and shot chamber therein for (a) filling said shot chamber with molten metal from said supply and (b) effecting an injection of said molten metal from said chamber into the cavity of said mold halves of said machine and to instantaneously withdraw shot pressure to permit unsolidified metal in the inlet runner section of the mold halves to drain out to provide a tubular runner attached to the part; and a second cylinder in said body including a selector valve adapted in one position to (a) open a first passageway from said metal supply to said shot chamber of the intensifying piston while (b) simultaneously closing off a second passageway to the nozzle of the injection system and in another position to (c) close off said first passageway and simultaneously open the second passageway, said selector valve being situated between the shot chamber of the intensifying piston and the second passageway.

4. A die-casting machine according to claim 1 wherein each of said mold halves include a nozzle-engaging insert on the mold parting line; and a multi-faceted nozzle of rectangular configuration on end view, the nozzle being oriented diagonally with respect to said mold parting line and having front and rear angulated faces adapted to mate with adjacent faces and surfaces in said inserts to maintain correct alignment therewith when the mold halves close around the nozzle.

5. A die-casting machine according to claim 1 including a cable type transfer system comprising an endless conveyor cable trained between the mold halves of the die-casting machine and a remotely positioned trimming machine; a plurality of fingers adjustably mounted on said cable for sequential positioning between said mold halves to receive a casting therearound; sprockets for driving said cable; and adjustable link means on said cable for engagement by said drive sprocket.

6. In a die-casting system of the type comprising, in combination:

(a) die-casting machine having a frame with two pairs of spaced, parallel cylinder assemblies mounted thereon, each pair of assemblies supporting a mold half and being opposed to the other pair of assemblies carrying the other mold half, each cylinder assembly of each pair comprising (i) a stationary piston secured to the frame, (ii) a piston shaft secured to and coaxial with the piston, said shaft extending across to a connection with an opposed piston of the other pair, (iii) a cylinder mounted on the piston and shaft for reciprocal movement thereon in response to incompressible fluid injected therein on either side of said piston; (iv) means connecting said cylinder to a said mold half, whereby injection of fluid into the cylinders at the crown ends of the pistons forces the cylinders and mold halves together and injection of the fluid at the skirt ends of the pistons forces the cylinders and mold halves apart with the terminal force from opening the cylinders being taken by the piston shaft; and (v) means for deceleration of said cylinders to eliminate closing shock; the improvements comprising (b) evaporative heat control means for said molds;

(c) a metal injection system including means for injecting metal into the molds along the parting plane of said molds and means associated with said metal injection system for subsequent drainage of unsolidified metal from said runner and a self-contained molten metal supply with heating means for said metal supply and (d) each of said mold halves includes a nozzle engaging insert associated with each mold half and mating on a plane corresponding to said mold parting plane; and a nozzle oriented to feed metal along said mold parting plane, said nozzle having a multi-faceted portion of rectangular configuration on end view and a neck portion contiguous with said multi-faceted portion; said multi-faceted portion of said nozzle having, in cross section taken along a line normal to said end view, front angulated faces diverging from a metal outlet end of said nozzle and rear angulated faces converging toward the cylindrical neck portion of said nozzle, said angulated faces adapted to mate with corresponding internal faces and surfaces formed in said nozzle-engaging insert to maintain correct alignment with the mold parting plane when the mold halves close; said nozzle including a flash guard comprising, on the neck portion of said nozzle, a portion of reduced surface area on cross section relative to the cross sectional surface area of the remainder of said neck portion, said reduced cross-sectional area portion of said neck portion being contiguous with said rear angulated faces and being provided with a curved shoulder which mates with the remainder of said neck portion, said curved shoulder being concave when viewed in said cross section and diverging outwardly toward a metal inlet end of said nozzle; and peripheral pockets formed in said internal faces of said nozzle-engaging inserts, said peripheral pockets cooperating to form a circumferential cavity when said inserts mate, being coaxial with but offset from said curved shoulder and cooperating with said shoulder to form a toroid such that leakage of molten metal from said nozzle is directed by said shoulder into said pocket.

7. In a die-casting system of the type comprising, in combination:

(a) die-casting machine having a frame with two pairs of spaced, parallel cylinder assemblies mounted thereon, each pair of assemblies supporting a mold half and being opposed to the other pair of assemblies carrying the other mold half, each cylinder assembly of each pair comprising (i) a stationary piston secured to the frame, (ii) a piston shaft secured to and coaxial with the piston, said shaft extending across to a connection with an opposed piston of the other pair, (iii) a cylinder mounted on the piston and shaft for reciprocal movement thereon in response to incompressible fluid injected therein on either side of said piston; (iv) means connecting said cylinder to a said mold half, whereby injection of fluid into the cylinders at the crown ends of the pistons forces the cylinders and mold halves together and injection of the fluid at the skirt ends of the pistons forces the cylinders and mold halves apart with the terminal force from opening the cylinders being taken by the piston shaft; and (v) means for deceleration of said cylinders to eliminate closing shock; the improvement comprising (b) evaporative heat control means for said molds;

(c) a metal injection system including means for injecting metal into the molds on the parting line of said molds and means associated with said metal injection system for subsequent drainage of unsolidified metal from said runner and a self-contained molten metal supply with heating means for said metal supply; and (d) means for positioning and releasing a casting comprising at least one positioning pin mounted in an ejector plate, associated with each mold half, and extending to the die face; means to rotate said pin comprising a tube coaxially mounted on said pin and having helical channels therein; a movable die plate associated with each said mold half, follower members mounted on said movable die plate and engaging said helical channels whereby linear movement of said die plate and followers causes rotation of said tube and pin to release the same from said casting; and means resiliently mounted on the pin in said ejector plate whereby the opening of the mold plate effects linear movement of said pin away from said casting.

8. A die-casting machine according to claim 7 including means for withdrawing core pins from said a casting comprising a plate member associated with at least one mold half and supporting at least one core pin, a tubular stripper tube surrounding said core pin, and hydraulic means associated with the mold half for withdrawing said plate and pin within said stripper tube.

9. In a die-casting system of the type including, in combination:

(a) die-casting machine having a frame with two pairs of spaced, parallel cylinder assemblies mounted thereon, each pair of assemblies supporting a mold half and being opposed to the other pair of assemblies carrying the other mold half, each cylinder assembly of each pair comprising (i) a stationary piston secured to the frame, (ii) a piston shaft secured to and coaxial with the piston, said shaft extending across to a connection with an opposed piston of the other pair, (iii) a cylinder mounted on the piston and shaft for reciprocal movement thereon in response to incompressible fluid injected therein on either side of said piston; (iv) means connecting said cylinder to a said mold half, whereby injection of fluid into the cylinders at the crown ends of the pistons forces the cylinders and mold halves together and injection of the fluid at the skirt ends of the pistons forces the cylinders and mold halves apart with the terminal force from opening the cylinders being taken by the piston shaft; and (v) means for deceleration of said cylinders to eliminate closing shock; the improvements comprising:

(b) evaporative heat control means for said mold halves including a closed cooling system in each of the mold halves with passages therein for the circulation of liquid through the molds; a fluid inlet valve associated with the passages; a make-up pump for injecting cooling liquid into the passages of the molds via said inlet valve; and a pressure responsive limiting valve associated with the passages for releasing evaporated liquid from the passages when boiling occurs therein at a predetermined pressure; and means associated with the pressure responsive limiting valve for directing condensed liquid back to a supply source thereof;

(c) a metal injection system including means for injecting metal into the molds on the parting line of said molds and means associated with said metal injection system for subsequent drainage of unsolidified metal from said runner and a self-contained molten metal supply with heating means for said metal supply;

(d) means for supporting a cast part in a fixed position between said mold halves after said mold halves have been withdrawn therefrom; and (e) a cable type transfer system to carry a casting from the die casting machine to a remotely positioned trimming machine or other secondary operation.

10. A die-casting machine according to claim 9 wherein said cable type transfer system comprising an endless conveyor cable trained between the mold halves of the die casting machine and said remotely positioned trimming machine; a plurality of fingers adjustably mounted on said cable for sequential positioning between said mold halves to receive a casting therearound; sprockets for driving said cable; and adjustable link means on said cable for engagement by said drive sprocket.

11. A die-casting machine according to claim 10 wherein said trimming machine comprises a pair of movable platens carrying a trim die and a trim punch and adapted to receive the conveyor cable, finger and casting therebetween; the die being adapted for movement into position before said punch to act as a backup to the punch; means for absorbing shock from the action of said punch; and hydraulic means for actuating said punch and die.

* * * * *